US007726641B2

(12) United States Patent
Miyake et al.

(10) Patent No.: US 7,726,641 B2
(45) Date of Patent: Jun. 1, 2010

(54) IMAGE FORMING APPARATUS, SHEET PROCESSING APPARATUS, AND METHOD OF CONTROLLING THE SHEET PROCESSING APPARATUS

(75) Inventors: Toshiyuki Miyake, Toride (JP); Manabu Yamauchi, Kashiwa (JP); Naoto Watanabe, Kashiwa (JP); Takayuki Fujii, Toshima-ku (JP); Shunsuke Nishimura, Toride (JP); Yushi Oka, Abiko (JP); Takashi Yokoya, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/406,251

(22) Filed: Mar. 18, 2009

(65) Prior Publication Data

US 2009/0179374 A1 Jul. 16, 2009

Related U.S. Application Data

(63) Continuation of application No. 11/466,096, filed on Aug. 21, 2006, now Pat. No. 7,527,255.

(30) Foreign Application Priority Data

Aug. 30, 2005 (JP) ..... 2005-250116

(51) Int. Cl.
*B65H 37/04* (2006.01)

(52) U.S. Cl. ..... 270/58.09; 270/58.01; 270/58.07; 270/58.08; 270/58.11; 270/58.12; 270/58.17; 270/58.27; 270/59

(58) Field of Classification Search ..... 270/32, 270/37, 52.18, 58.07, 58.08, 58.09, 58.11, 270/58.12, 58.17, 58.27, 59; 412/4, 5, 8, 412/11, 12, 16, 18, 19, 20, 37
See application file for complete search history.

(56) References Cited

U.S. PATENT DOCUMENTS

| | | | |
|---|---|---|---|
| 5,881,352 | A | 3/1999 | Kobayashi et al. |
| 6,532,856 | B2 | 3/2003 | Kato et al. |
| 2007/0035081 | A1 | 2/2007 | Kaneko et al. |

FOREIGN PATENT DOCUMENTS

| | | | |
|---|---|---|---|
| JP | 2005-104063 | A | 4/2005 |

*Primary Examiner*—Gene Crawford
*Assistant Examiner*—Leslie A Nicholson, III
(74) *Attorney, Agent, or Firm*—Rossi, Kimms & McDowell LLP

(57) ABSTRACT

An image forming apparatus which enables the user to easily remove a sheet bundle left in the apparatus after a bookbinding-mode job is stopped in the middle of execution thereof. In a bookbinding mode of the apparatus, in a sheet stacking section, a plurality of sheets having images formed thereon are stacked as a sheet bundle; in a gluing section, glue is applied to an end face of the sheet bundle; and in a bonding section, a cover sheet is bonded to the sheet bundle to wrap the sheet bundle in the cover sheet. When a bookbinding-mode job is canceled during execution thereof, in the gluing section, glue is applied to the sheet bundle stacked in the stacking section before the job is stopped, and a discharge section discharges the glue-applied sheet bundle which is neither wrapped nor trimmed.

13 Claims, 41 Drawing Sheets

*FIG. 39*

SET ORIGINALS ON DOCUMENT FEEDER

FINISH

*FIG. 40*

READING OF ORIGINAL FOR GLUED-ON COVER

SET ORIGINAL FOR GLUED-ON COVER ON
DOCUMENT FEEDER, AND PRESS START BUTTON

CANCEL

IMAGE FORMING APPARATUS, SHEET PROCESSING APPARATUS, AND METHOD OF CONTROLLING THE SHEET PROCESSING APPARATUS

This is a continuation of U.S. patent application Ser. No. 11/466,096 filed on Aug. 21, 2006.

BACKGROUND OF THE INVENTION

1. Field of the Invention

The present invention relates to an image forming apparatus and a sheet processing apparatus which are provided with a bookbinding mode for forming images on sheets and bundling and bookbinding the sheets having the respective images formed thereon, and a method of controlling the sheet processing apparatus.

2. Description of the Related Art

Conventionally, as a post-processing unit of an image forming apparatus, there has been proposed a glue binding device which glues one side of a sheet bundle comprised of a plurality of sheets, encases the sheet bundle in a cover sheet, and selectively trims the other sides of the sheet bundle (see e.g. Japanese Laid-Open Patent Publication (Kokai) No. 2005-104063).

In the conventional glue binding device, in the case where a job of the image forming apparatus is stopped in the middle of execution thereof e.g. in response to job cancellation by depression of a stop key of the image forming apparatus, sheets having respective images formed thereon are sequentially discharged from the image forming apparatus until the job is actually stopped. The discharged sheets are sequentially stacked into a bundle within the glue binding device. This sheet bundle does not contain all pages of the job, or in other words, the sheet bundle is an unfinished article, so that the user has to remove the sheet bundle from the glue binding device.

However, the stacked sheet bundle is sandwiched with a predetermined pressure, and hence a large force is required for the user to remove the sheet bundle from the apparatus, which can make it difficult to carry out the removal. Further, the side alignment of sheets of the sheet bundle can be inconveniently lost during the removal operation, which can cost the user time and labor.

SUMMARY OF THE INVENTION

It is an object of the present invention to provide an image forming apparatus, a sheet processing apparatus, and a method of controlling the sheet processing apparatus, which enable the user to easily remove a sheet bundle left in the apparatus after a bookbinding-mode job is stopped in the middle of execution thereof.

To attain the above object, in a first aspect of the present invention, there is provided an image forming apparatus provided with a bookbinding mode for forming images on a plurality of sheets and binding the sheets having the images formed thereon into a book, comprising a sheet stacking device that stacks a plurality of sheets having images formed thereon as a sheet bundle, a gluing device that applies glue to an end face of the sheet bundle stacked on the sheet stacking device, a wrapping device that bonds a cover sheet to the sheet bundle having the end face thereof glued, to thereby wrap the sheet bundle in the cover sheet, a discharge device that discharges the sheet bundle wrapped in the cover sheet from the apparatus, and a control device that performs control on a bookbinding-mode job such that the control device causes the gluing device to apply glue to the sheet bundle stacked on the sheet stacking device, causes the wrapping device to wrap the glue-applied sheet bundle in the cover sheet, and causes the discharge device to discharge the sheet bundle wrapped in the cover sheet, wherein when the bookbinding-mode job is canceled during execution thereof, the control device causes the gluing device to apply glue to the sheet bundle stacked on the sheet stacking device before the job is stopped, and causes the discharge device to discharge the glue-applied sheet bundle without causing the wrapping device to wrap the glue-applied sheet bundle in the cover sheet.

Preferably, the image forming apparatus comprises a cutting device that trims off a predetermined portion from the sheet bundle wrapped in the cover sheet by the wrapping device, the control device performing control on the bookbinding-mode job such that the control device causes the cutting device to trim the sheet bundle wrapped in the cover sheet, and then causes the discharge device to discharge the trimmed sheet bundle, and wherein when the bookbinding mode job is canceled during execution thereof, the control device causes the discharge device to discharge the glue-applied sheet bundle without causing the wrapping device to wrap the glue-applied sheet bundle in the cover sheet and without causing the cutting device to trim the glue-applied sheet bundle.

Further, preferably, the image forming apparatus comprises a book loading device that has the sheet bundle wrapped in the cover sheet loaded thereon in a manner removable from outside, and when the bookbinding-mode job is canceled during execution thereof, the control device causes the glue-applied sheet bundle to be loaded on the book loading device.

More preferably, the image forming apparatus comprises a display device that displays messages for a user, and when the bookbinding-mode job is canceled during execution thereof, the control device causes the display device to display a message prompting the user to remove the glue-applied sheet bundle loaded on the book loading device.

To attain the above object, in a second aspect of the present invention, there is provided a sheet processing apparatus that is connected to an image forming apparatus for forming images on sheets, and binds a plurality of sheets having images formed thereon by the image forming apparatus into a book, comprising a sheet stacking device that stacks a plurality of sheets having images formed thereon as a sheet bundle, a gluing device that applies glue to an end face of the sheet bundle stacked on the sheet stacking device, a wrapping device that bonds a cover sheet to the sheet bundle having the end face thereof glued, to thereby wrap the sheet bundle in the cover sheet, a discharge device that discharges the sheet bundle wrapped in the cover sheet from the sheet processing apparatus, and a control device that performs control on a bookbinding-mode job such that the control device causes the gluing device to apply glue to the sheet bundle stacked on the sheet stacking device, causes the wrapping device to wrap the glue-applied sheet bundle in the cover sheet, and causes the discharge device to discharge the sheet bundle wrapped in the cover sheet, wherein when the bookbinding-mode job is canceled during execution thereof, the control device causes the gluing device to apply glue to the sheet bundle stacked on the sheet stacking device before the job is stopped, and causes the discharge device to discharge the glue-applied sheet bundle without causing the wrapping device to wrap the glue-applied sheet bundle in the cover sheet.

Preferably, the sheet processing apparatus comprises a cutting device that trims off a predetermined portion from the sheet bundle wrapped in the cover sheet by the wrapping device, the control device performing control on the bookbinding-mode job such that the control device causes the cutting device to trim the sheet bundle wrapped in the cover sheet and then causes the discharge device to discharge the trimmed sheet bundle, and when the bookbinding mode job is canceled during execution thereof, the control device causing the discharge device to discharge the glue-applied sheet bundle without causing the wrapping device to wrap the glue-applied sheet bundle in the cover sheet and without causing the cutting device to trim the glue-applied sheet bundle.

Further, preferably, the sheet processing apparatus comprises a book loading device that has the sheet bundle wrapped in the cover sheet loaded thereon in a manner removable from outside, and when the bookbinding-mode job is canceled during execution thereof, the control device causes the glue-applied sheet bundle to be loaded on the book loading device.

To attain the above object, in a third aspect of the present invention, there is provided a method of controlling a sheet processing apparatus comprising a sheet stacking device that stacks a plurality of sheets having images formed thereon as a sheet bundle, a gluing device that applies glue to an end face of the sheet bundle stacked on the sheet stacking device, a wrapping device that bonds a cover sheet to the sheet bundle having the end face thereof glued, to thereby wrap the sheet bundle in the cover sheet, and a discharge device that discharges the sheet bundle wrapped in the cover sheet from the sheet processing apparatus, comprising a first control step of performing control on a bookbinding-mode job such that by causing the gluing device to apply glue to the sheet bundle stacked on the sheet stacking device, causing the wrapping device to wrap the glue-applied sheet bundle in the cover sheet, and causing the discharge device to discharge the sheet bundle wrapped in the cover sheet, and a second control step of causing the gluing device to apply glue to the sheet bundle stacked on the sheet stacking device before the job is stopped, and causing the discharge device to discharge the glue-applied sheet bundle without causing the wrapping device to wrap the glue-applied sheet bundle in the cover sheet, when the bookbinding-mode job is canceled during execution thereof.

According to the present invention, the user can easily remove a sheet bundle left in the apparatus after a bookbinding-mode job is stopped in the middle of execution thereof.

The above and other objects, features, and advantages of the invention will become more apparent from the following detailed description taken in conjunction with the accompanying drawings.

BRIEF DESCRIPTION OF THE DRAWINGS

FIG. 39 is a view illustrating a screen prompting the user to set originals on a document feeder;

FIG. 40 is a view illustrating a screen prompting the user to set an original for a glued-on cover and cause the original to be read;

DETAILED DESCRIPTION OF THE PREFERRED EMBODIMENTS

The present invention will now be described in detail below with reference to the drawings showing preferred embodiments thereof.

Figure 1:
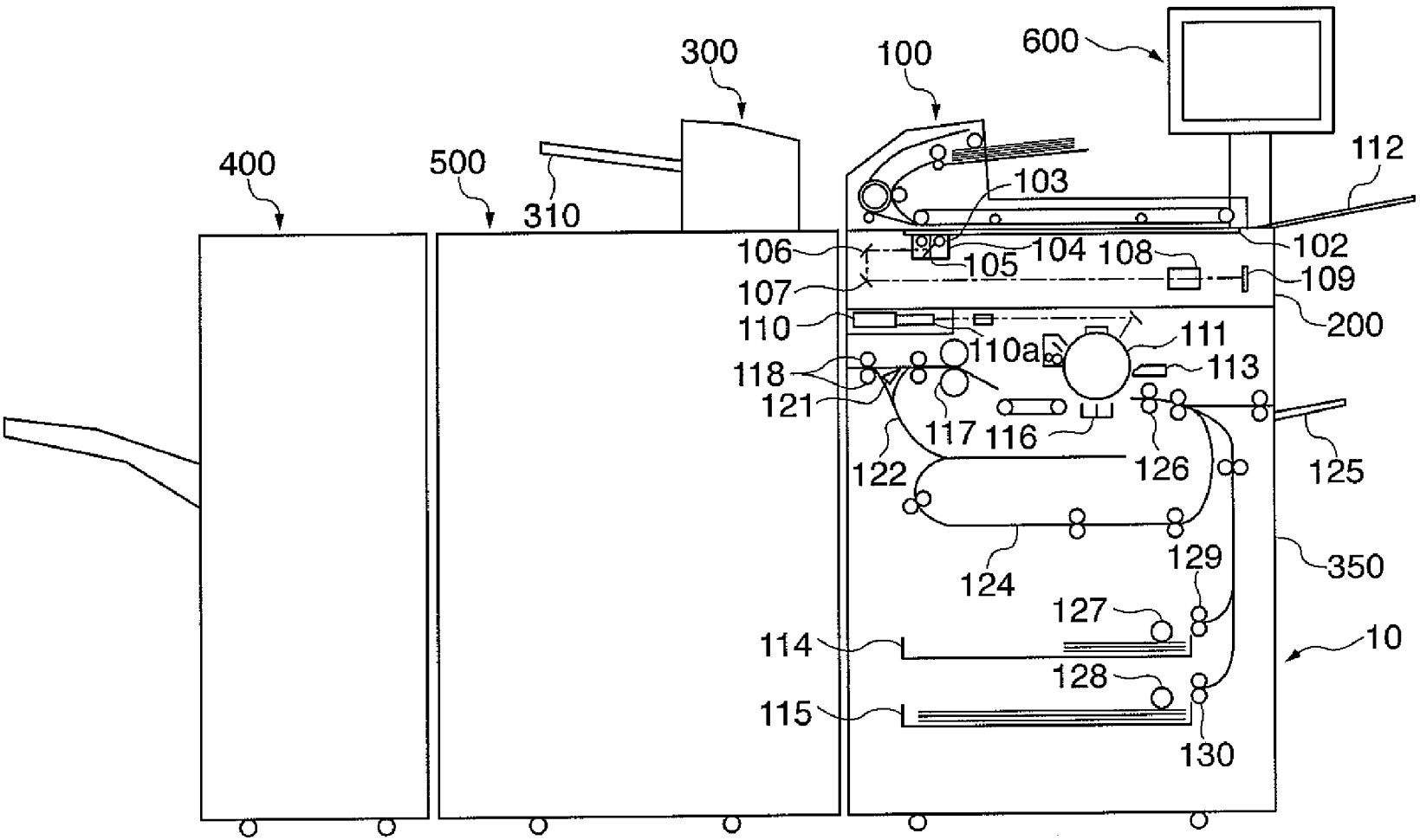
FIG. 1 is a longitudinal cross-sectional view of essential parts of an image forming apparatus to which is connected a glue binding unit implementing a sheet processing apparatus according to a first embodiment of the present invention.

FIG. 1 is a longitudinal cross-sectional view of a main part of an image forming apparatus. A sheet processing unit according to a first embodiment of the present invention is connected to the image forming apparatus. This sheet processing unit includes a glue binding unit. The glue binding unit is provided with a sheet stacking device which stacks sheets delivered from the image forming apparatus, as a sheet bundle, and performs processing, including gluing and cutting or trimming, on the sheet bundle to thereby bind the sheet bundle into a book.

As shown in FIG. 1, the image forming apparatus is comprised of an image forming apparatus main unit 10 and the sheet processing unit. The image forming apparatus main unit 10 includes an image reader 200 that reads an image on an original, and a printer 350 that forms the image read by the image reader 200 on a sheet. The image forming apparatus main unit 10 is further provided with an operating and display unit 600. The operating and display unit 600 includes a plurality of keys for configuring various functions for image forming operation, and a display section for displaying information indicative of settings. The operating and display unit 600 will be described in detail hereinafter. The sheet processing unit includes the glue binding unit 500 and a finisher 400.

The image reader 200 of the image forming apparatus main unit 10 is equipped with a document feeder 100. The document feeder 100 sequentially feeds originals set on an original tray with their front surfaces facing upward, one by one from the leading page, such that the originals are guided along a curved path and conveyed onto a platen glass 102 and then through a moving original reading position on the platen glass 102, followed by being discharged onto an external discharge tray 112.

As each original passes the moving original reading position on the platen glass 102 from left to right, an image of the original is continuously read by a scanner unit 104 held in a position corresponding to the moving original reading position. This reading method is generally called the "moving original reading method".

More specifically, as the original passes the moving original reading position, a surface of the original to be scanned is illuminated by light from a lamp 103 of the scanner unit 104, and reflected light from the original is guided into a lens 108 via mirrors 105, 106, and 107. The light having passed through the lens 108 forms an image on an imaging surface of an image sensor 109.

Each original is thus conveyed so as to pass the moving original reading position from left to right, whereby scanning is performed to read the original with a direction orthogonal to the conveying direction of the original as the main scanning direction and the conveying direction of the original as the sub scanning direction. More specifically, as the original passes the moving original reading position, the image of the original is read line by line in the main scanning direction by the image sensor 109 while the original is being fed in the sub scanning direction, whereby the whole original image is read. The optically read original image is converted into image data by the image sensor 109 and then output from the same. The image data output from the image sensor 109 is input as a video signal to an exposure control section 110 of the printer 350.

Alternatively, it is also possible to convey the original to a predetermined position on the platen glass 102 and temporarily stop the same, and cause the scanner unit 104 to scan the original in this state from left to right to thereby read the original. This reading method is the so-called "stationary original reading method".

An original can also be read without using the document feeder 100. In this case, first, the user lifts the document feeder 100 and places an original on the platen glass 102, whereafter the scanner unit 104 is caused to scan the original from left to right to read the same. In short, when the document feeder 100 is not used for reading an original, stationary original reading is performed.

The exposure control section 110 of the printer 350 modulates a laser beam based on the video signal output from the image reader 200 and then outputs the modulated laser beam. The laser beam is irradiated onto a photosensitive drum 111 while being scanned by a polygon mirror 110*a*. On the photosensitive drum 111, an electrostatic latent image is formed according to the scanned laser beam. The electrostatic latent image formed on the photosensitive drum 111 is visualized as a developer image by a developer supplied from a developing device 113.

The developer image formed on the photosensitive drum 111 is transferred by the transfer section 116 onto a sheet fed from an upper cassette 114 or a lower cassette 115, or a manual sheet feeder 125. Each of the upper and lower cassettes 114 and 115 accommodates sheets of a size corresponding thereto. A sheet in the upper cassette 114 is picked up by a pickup roller 127 and fed by a feed roller 129, while a sheet in the lower cassette 115 is picked up by a pickup roller 128 and fed by a feed roller 130. Further, a sheet of a size corresponding to the manual sheet feeder 125 is placed on the manual sheet feeder 125 to be fed therefrom. The sheet fed from the upper cassette 114, the lower cassette 115, or the manual sheet feeder 125 is conveyed until its leading end is brought into abutment with a registration roller 126, and temporarily stopped there. Then, the sheet is conveyed in between the photosensitive drum 111 and a transfer section 116 in timing synchronous with the start of irradiation of the laser beam. This causes the developer image formed on the photosensitive drum 111 to be transferred onto the sheet. The sheet having the developer image transferred thereon is conveyed to a fixing section 117, and the fixing section 117 fixes the developer image on the sheet by heating and pressing the sheet.

The sheet having passed through the fixing section 117 passes through a flapper 121 and a discharge roller pair 118 so as to be discharged from the printer 350 toward the glue binding unit 500. When the sheet is to be discharged face-down, i.e. with an image-formed surface thereof facing downward, the sheet having passed through the fixing section 117 is temporarily guided into an inverting path 122 by switching operation of the flapper 121, and then, after the trailing edge of the sheet has passed through the flapper 121, the sheet is switched back and discharged from the printer 350 by the discharge roller pair 118. This sheet discharge mode will be hereinafter referred to as "inverted discharge". The inverted discharge is carried out when images are sequentially formed starting with the leading page. The sheets thus discharged by the inverted discharge are stacked in the correct page order.

When a hard sheet, such as an OHP sheet, is supplied from the manual sheet feeder 125, and an image is formed on this sheet, the sheet is not guided into the inverting path 122, and hence discharged by the discharge roller pair 118, face-up, i.e. with an image-formed surface thereof facing upward.

Further, when a double-sided printing mode for forming images on both sides of a sheet is set, the sheet is guided into the inverting path 122 by switching operation of the flapper 121, and then conveyed to a double-sided conveying path 124, followed by being fed in again between the photosensitive drum 111 and the transfer section 116 in the timing synchronous with the start of irradiation of the laser beam.

Figure 2:
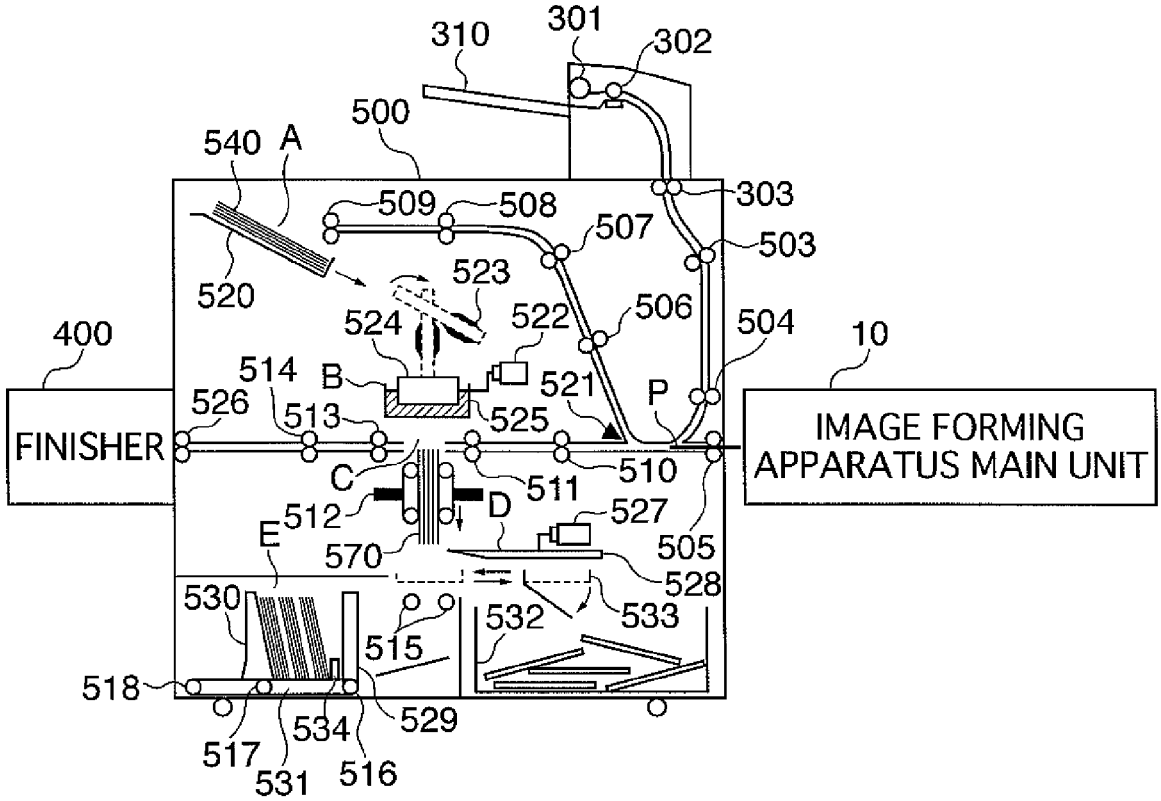
FIG. 2 is a longitudinal cross-sectional view of the internal construction of the glue binding unit appearing in FIG. 1.

Next, the glue binding unit 500 will be described with reference to FIG. 2. FIG. 2 is a longitudinal cross-sectional view of the internal construction of the glue binding unit 500 appearing in FIG. 1.

As shown in FIG. 2, the glue binding unit 500 is comprised of a sheet stacking section A, a gluing section B, a bonding section C, a cutting section D, and a book discharging section E.

The sheet stacking section A stacks sheets discharged from the image forming apparatus main unit 10 (printer 350) in a bookbinding mode, as a bundle on a sheet stacking tray 520 to thereby form a sheet bundle 540. The sheet bundle 540 formed by the sheet stacking section A is conveyed to the gluing section B.

In the gluing section B, a glue-applying roller 524 is driven by a glue-applying roller control motor 522. The glue-applying roller 524 applies glue to a lower end face of the sheet bundle while rotating in a state soaked in glue in a glue container 525. Then, the glue-applying roller 524 and the glue container 525 are retreated in unison by a driving means, not shown, and the glue-applied sheet bundle is conveyed to the bonding section C.

The bonding section C bonds the glue-applied sheet bundle 540 to a cover sheet fed from the image forming apparatus main unit 10 or from the inserter 300 to thereby wrap the sheet bundle 540 in the cover sheet. Then, the sheet bundle 540 wrapped in the cover sheet is delivered as a book 570 to a trim gripper 512. Further, the book 570 is conveyed to the cutting section D by the trim gripper 512.

In the cutting section D, a cutter 528 is driven by a cutter control motor 527 to move horizontally so as to cut off a predetermined portion of the book 570 or trim the book 570. Chips from the trimmed book 570 drop into a chip receiving box 533. When a sequence of cutting operations are completed, the chip receiving box 533 is moved to a predetermined position, where the chips in the chip receiving box 533 are collected in a chip waste box 532. The book 570 completely trimmed in the cutting section D is conveyed from the cutting section D to the book discharging section E.

The book discharging section E is provided with an inlet roller pair 515 for receiving the book 570 conveyed from the cutting section D by the trim gripper 512. The book 570 received by the inlet roller pair 515 is temporarily placed on a loading plate 529. The loading plate 529 pivotally moves to cause the book 570 to stand against a book support plate 530. The lower end of the book 570 standing against the book support plate 530 is supported by a book discharge stabilizing plate 534. The book support plate 530 is moved leftward by a discharge conveyor belt 531, to thereby secure a discharge space for the next book to be conveyed. The discharge conveyor belt 531 is driven by a plurality of rollers 516, 517, and 518.

The inserter 300 is disposed on an upper part of the glue binding unit 500. The inserter 300 feeds cover sheets stacked on a feed tray 310 one by one by a feed roller 301. A cover sheet fed from the feed tray 310 is conveyed toward a switching flapper 521 by conveying roller pairs 303, 503, and 504.

The glue binding unit 500 is thus capable of operating in the bookbinding mode for forming a sheet bundle and making the sheet bundle into a book, as described above. Besides the bookbinding mode, the glue binding unit 500 is capable of operating in a normal discharge mode without performing a bookbinding operation.

The switching flapper 521 is disposed at a location downstream of a conveying roller pair 505 so as to enable the glue binding unit 500 to operate in the normal discharge mode. The switching flapper 521 selectively guides a sheet conveyed by the conveying roller pair 505 to the sheet stacking tray 520 of the sheet stacking section A or the finisher 400 as a post processing unit.

In the normal mode, a sheet P discharged from the image forming apparatus main unit 10 is conveyed by the conveying roller pair 505 and other conveying roller pairs 510, 511, 513, and 514, and discharged by discharge rollers 526 into the finisher 400. The finisher 400 is capable of performing post-processing, such as bundle discharge processing, binding processing, folding processing, and bookbinding processing, on a sheet bundle.

Figure 3:
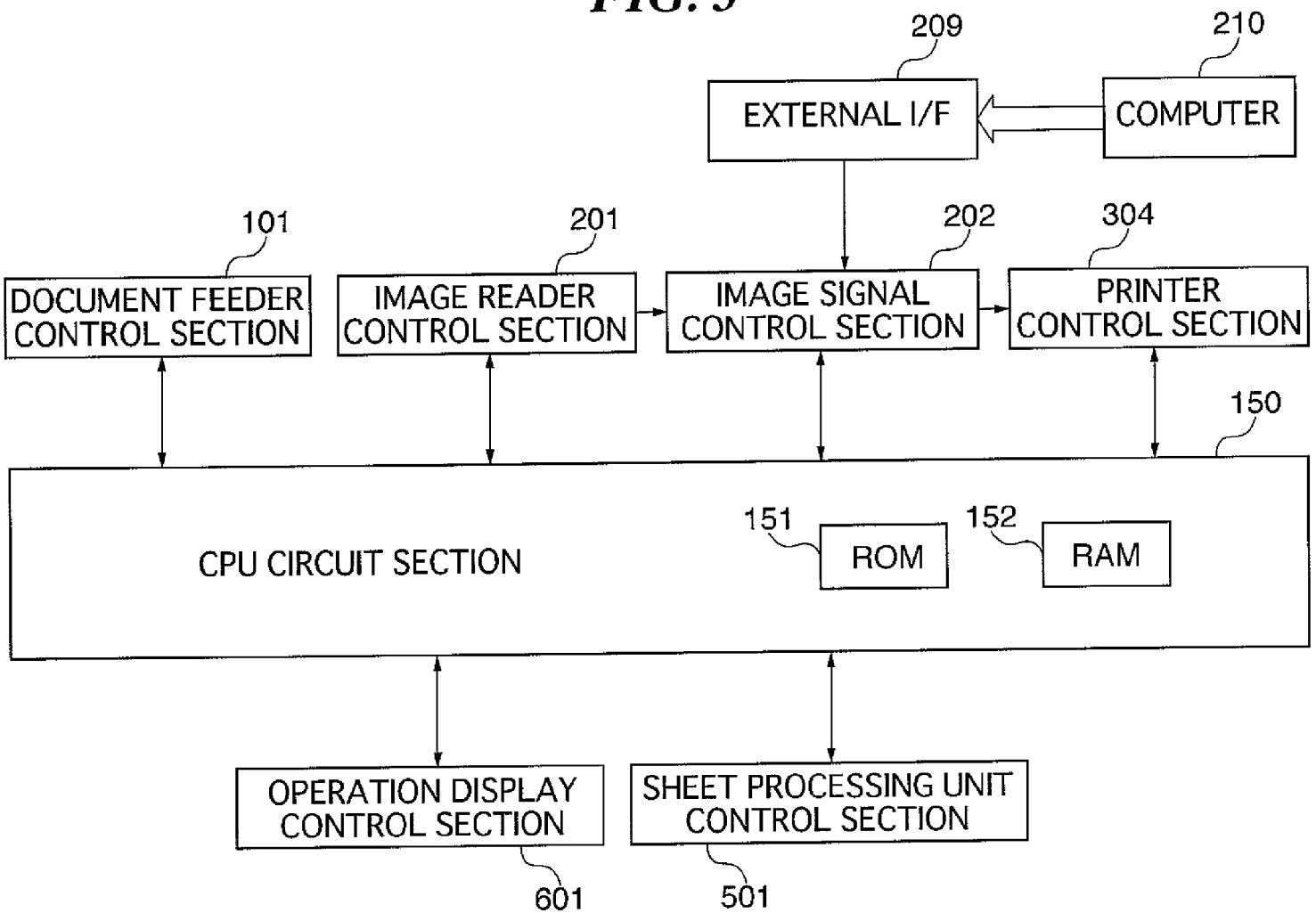
FIG. 3 is a block diagram of the configuration of a controller controlling the overall operation of the image forming apparatus in FIG. 1.

Next, the configuration of a controller controlling the overall operation of the image forming apparatus will be described with reference to FIG. 3. FIG. 3 is a block diagram of the configuration of the controller.

As shown in FIG. 3, the controller includes a CPU circuit section 150 incorporating a CPU, not shown, a ROM 151, and a RAM 152. The CPU circuit section 150 performs centralized control of a document feeder control section 101, an image reader control section 201, an image signal control section 202, an external I/F 209, a printer control section 304, an operation display control section 601, and a sheet processing unit control section 501 by executing control programs stored in the ROM 151. The RAM 152 temporarily stores control data, and is also used as a work area for carrying out arithmetic operations involved in control processing.

The document feeder control section 101 controls the document feeder 100 according to instructions from the CPU circuit section 150. The image reader control section 201 controls the scanner unit 104, the image sensor 109, and so forth, and transfers an analog image signal output from the image sensor 109 to the image signal control section 202.

The image signal control section 202 converts the analog image signal from the image sensor 109 into a digital signal, and then performs various kinds of processing on the digital signal. The processed digital signal is converted into a video signal, and the video signal is delivered to the printer control section 304. Further, the image signal control section 202 performs various kinds of processing on a digital image signal input from the computer 210 via the external I/F 209. The processed digital image signal is converted into a video signal, and the video signal is delivered to the printer control section 304. The operations executed by the image signal control section 202 are controlled by the CPU circuit section 150. The printer control section 304 drives the exposure control section 110 based on the received video signal.

The operation display control section 601 controls exchange of information between the operating and display unit 600 and the CPU circuit section 150. For example, the operation display control section 601 outputs key signals corresponding to respective operations of keys to the CPU circuit section 150, and delivers pieces of information to be displayed from the CPU circuit section 150 to the operating and display unit 600 to cause the same to display the information thereon.

The sheet processing unit control section 501 controls the glue binding unit 500 and the finisher 400 according to instructions from the CPU circuit section 150.

Next, sheet conveyance in the glue binding unit 500 will be described with reference to FIGS. 4 to 7. FIGS. 4 to 7 are views schematically showing conveyance of sheets and gluing of a sheet bundle in the glue binding unit 500.

Figure 4:
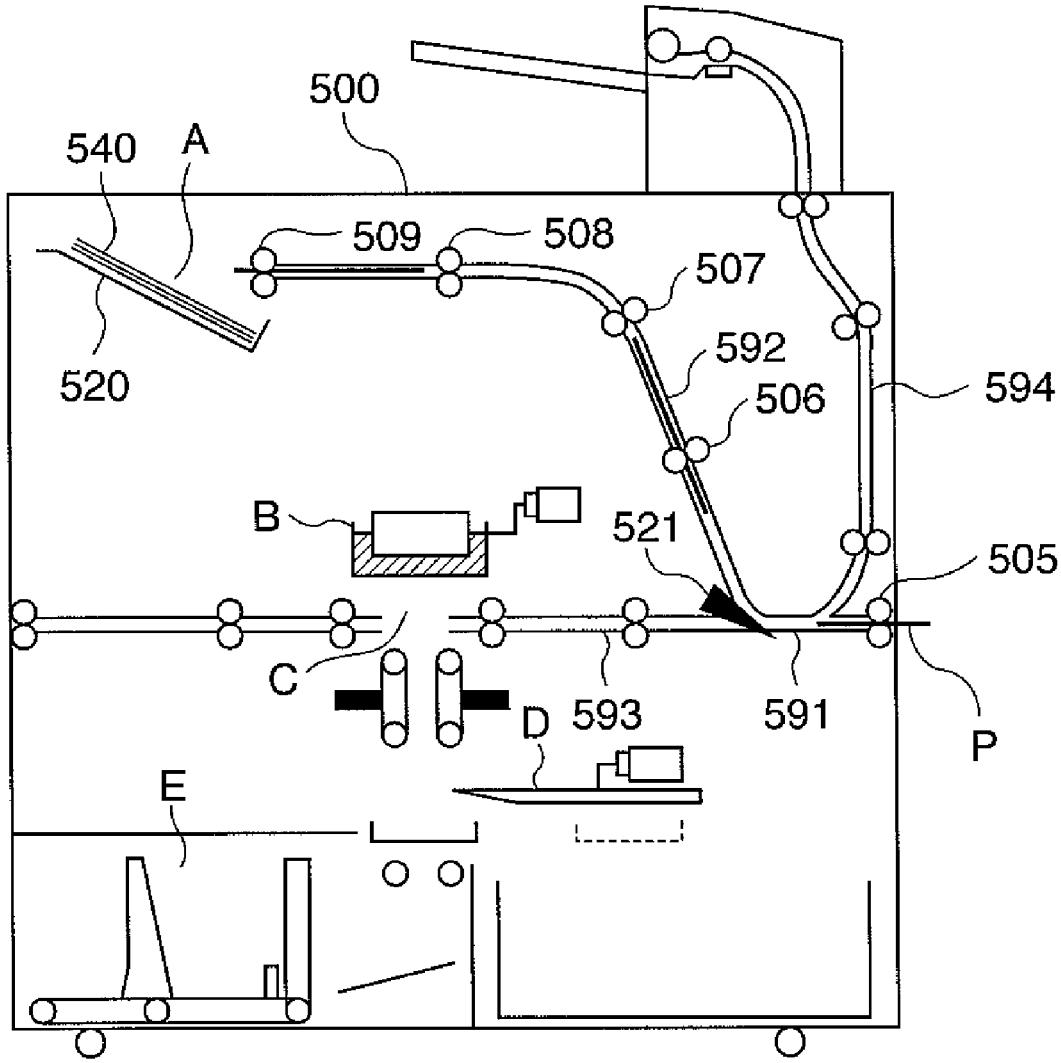
FIG. 4 is a view schematically showing how sheets are taken into the glue binding unit and how a sheet bundle is formed at a sheet stacking section of the glue binding device.
Figure 5:
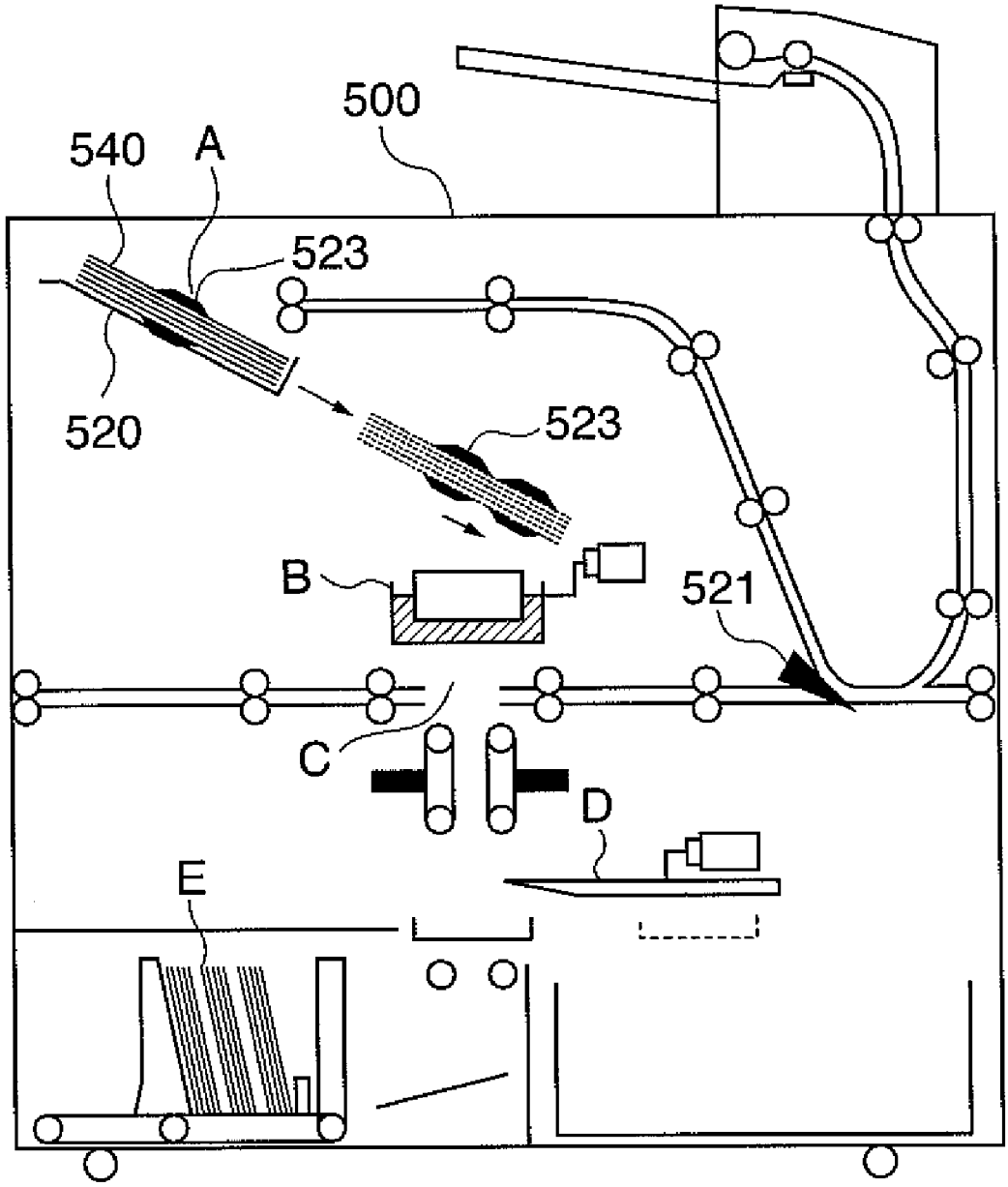
FIG. 5 is a view schematically showing how the sheet bundle is conveyed from the sheet stacking section to a gluing section within the glue binding unit.

As shown in FIG. 4, the glue binding unit 500 takes in a sheet P discharged from the image forming apparatus main unit 10, via the conveying roller pair 505. The sheet P taken in is guided into a conveying path 591. When the sheet P taken in by the conveying roller pair 505 is an intermediate sheet (i.e. a sheet other than a cover sheet) for a sheet bundle, the sheet P is guided into a conveying path 592 by the switching flapper 521 to be conveyed by conveying roller pairs 506, 507, 508, and 509. Then, the sheet P is discharged from the conveying roller pair 509 onto the sheet stacking tray 520 of the sheet stacking section A. When sheets as intermediate sheets are all discharged onto the sheet stacking tray 520, a sheet bundle 540 of the intermediate sheets is gripped by a gluing gripper 523 as shown in FIG. 5. Then the sheet bundle 540 is moved from the sheet stacking section A to a location above the gluing section B.

Figure 6:
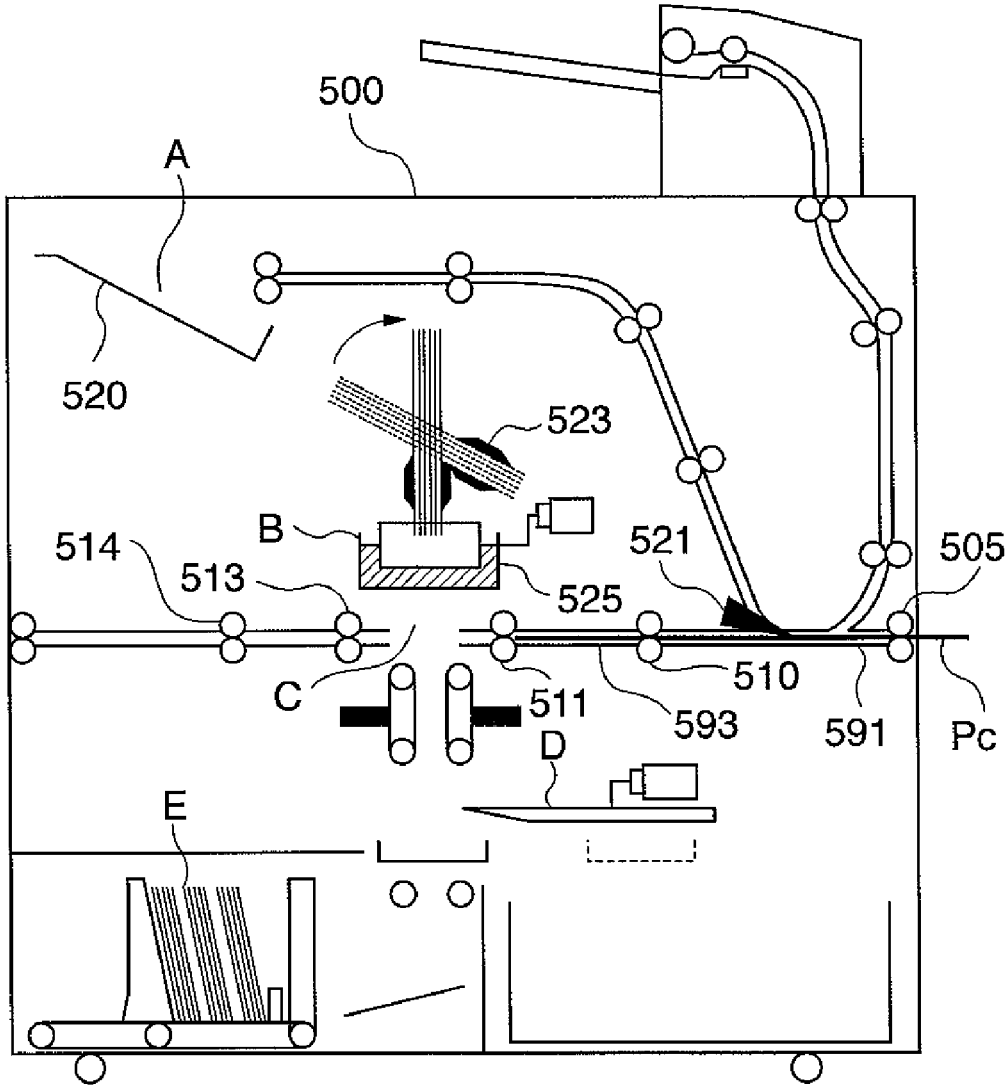
FIG. 6 is a view schematically showing how the sheet bundle is glued and how a cover sheet is taken into the glue binding unit.
Figure 7:
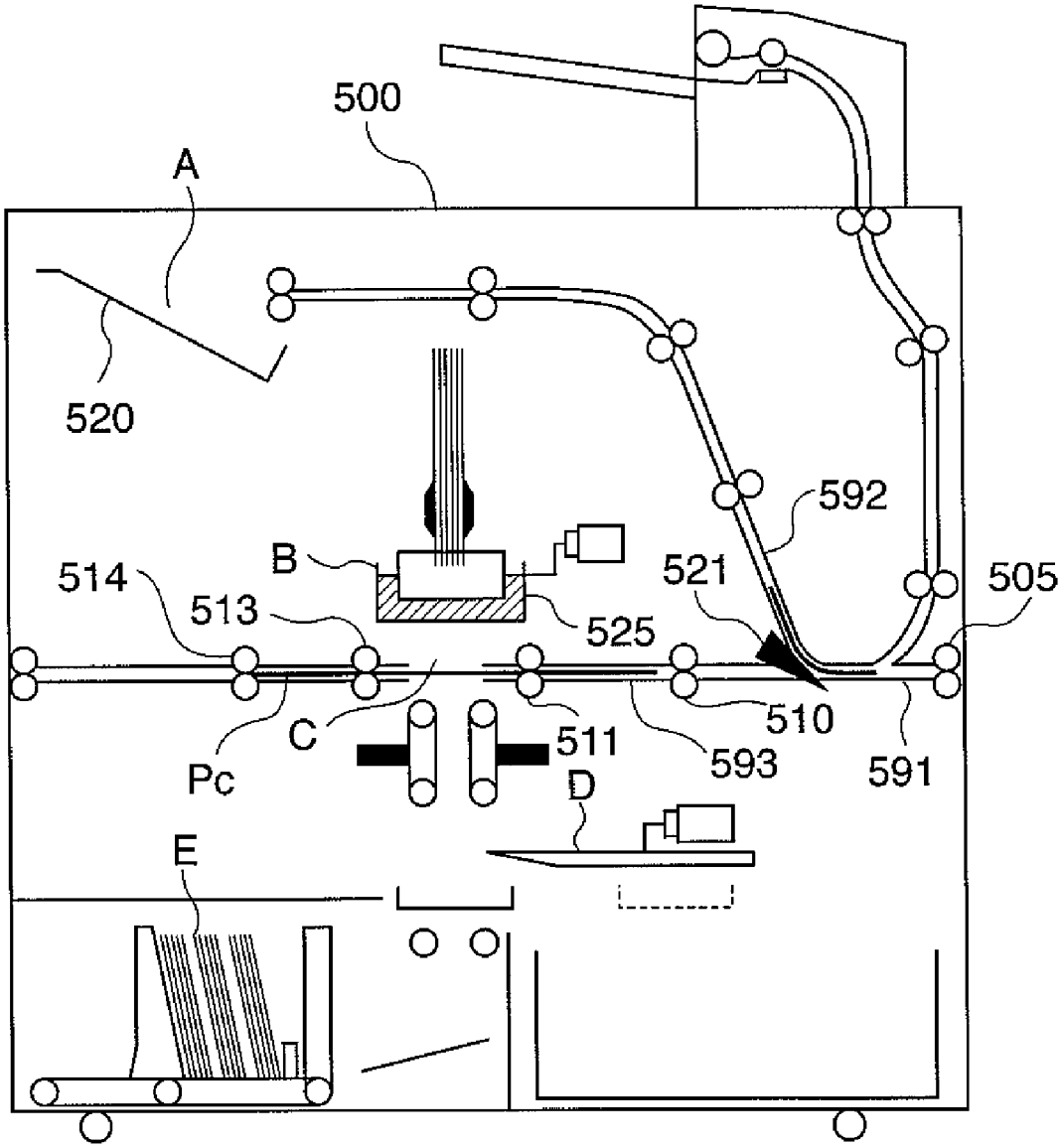
FIG. 7 is a view schematically showing how the cover sheet is conveyed.

The sheet bundle 540 moved to the location above the gluing section B is rotated to a vertically oriented position, as shown in FIG. 6, in a state gripped by the gluing gripper 523. Thus, the sheet bundle 540 is positioned such that an end thereof corresponding to the spine of a book faces the gluing section B. Thereafter, as described in detail hereinafter, the glue container 525 and the glue-applying roller 524 are moved along the sheet bundle, whereby glue is applied to the end of the sheet bundle. In the meantime, a cover sheet Pc is discharged from the image forming apparatus main unit 10 and taken into the glue binding unit 500 by the conveying roller pair 505. The cover sheet Pc is guided through the conveying path 591 into a conveying path 593 to be conveyed by the conveying roller pairs 510, 511, 513, and 514. At a location downstream of the conveying roller pair 513 in the conveying path 593, there is disposed a sensor, not shown. When the cover sheet Pc is conveyed by a predetermined distance after the leading end of the cover sheet Pc was detected by the sensor, the conveyance of the cover sheet Pc is stopped.

At a time point when the cover sheet Pc is stopped in the conveying path 593, the trailing end of the cover sheet Pc has already passed through the switching flapper 521. Therefore, in the case where a plurality of sheet bundles are formed successively, the switching flapper 521 can be switched even when a cover sheet Pc is staying within the conveying path 593. This makes it possible to receive each of intermediate sheets from the image forming apparatus main unit 10 so as to form a succeeding sheet bundle, and sequentially convey the intermediate sheets to the sheet stacking tray 520 through the conveying paths 591 and 592.

Thereafter, the glue-applied sheet bundle is wrapped in the cover sheet Pc and then conveyed downstream. This operation will be described in detail hereinafter.

The cover sheet Pc can also be fed from the inserter 300. In other words, it is possible to select one of the image forming apparatus main unit 10 and the inserter 300 as a sheet feed source of cover sheets.

Figure 8:
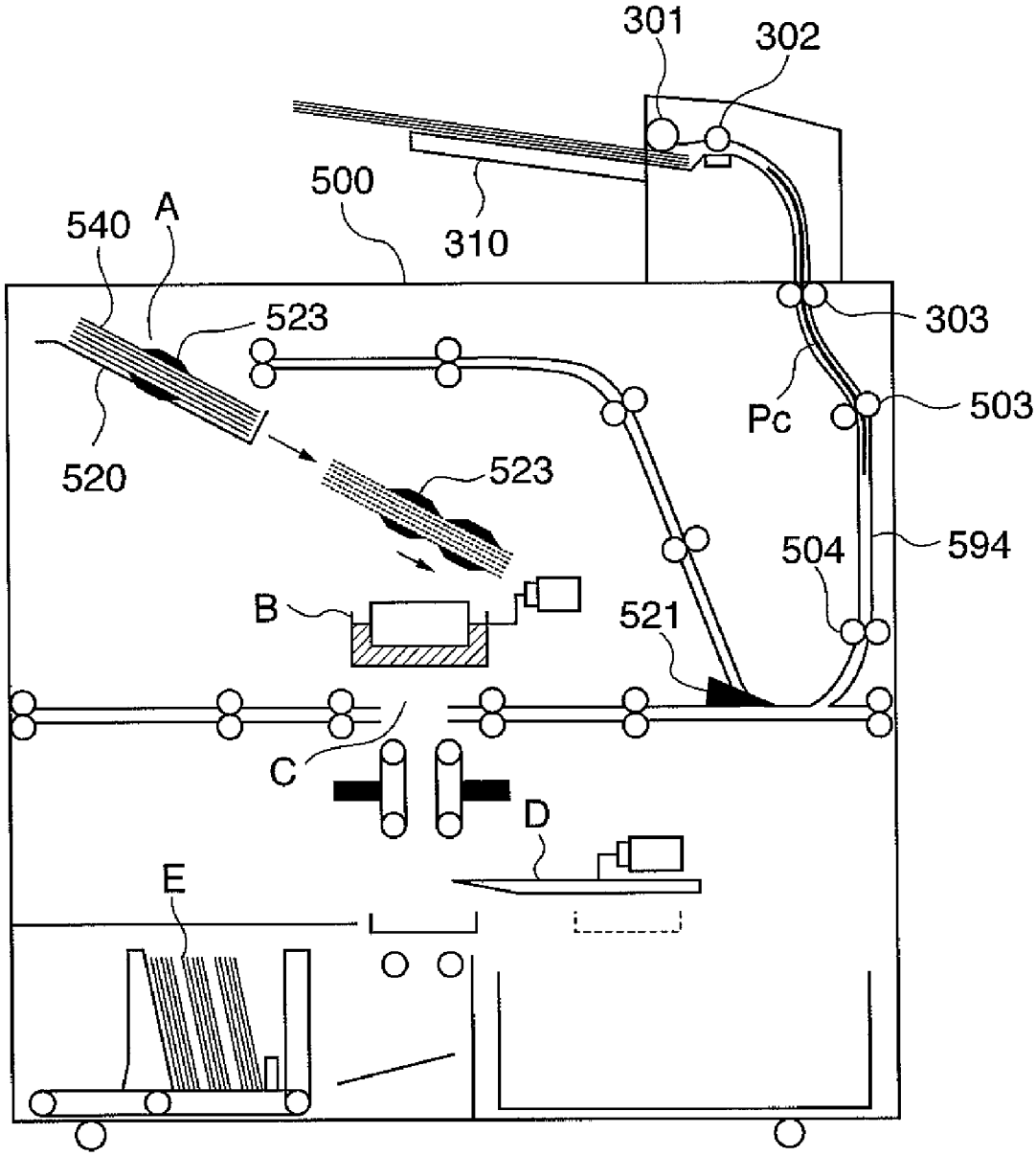
FIG. 8 is a view schematically showing how the cover sheet is conveyed, and how the sheet bundle is conveyed from the sheet stacking section to the gluing section, in the case where the cover sheet is fed from an inserter for bookbinding.
Figure 9:
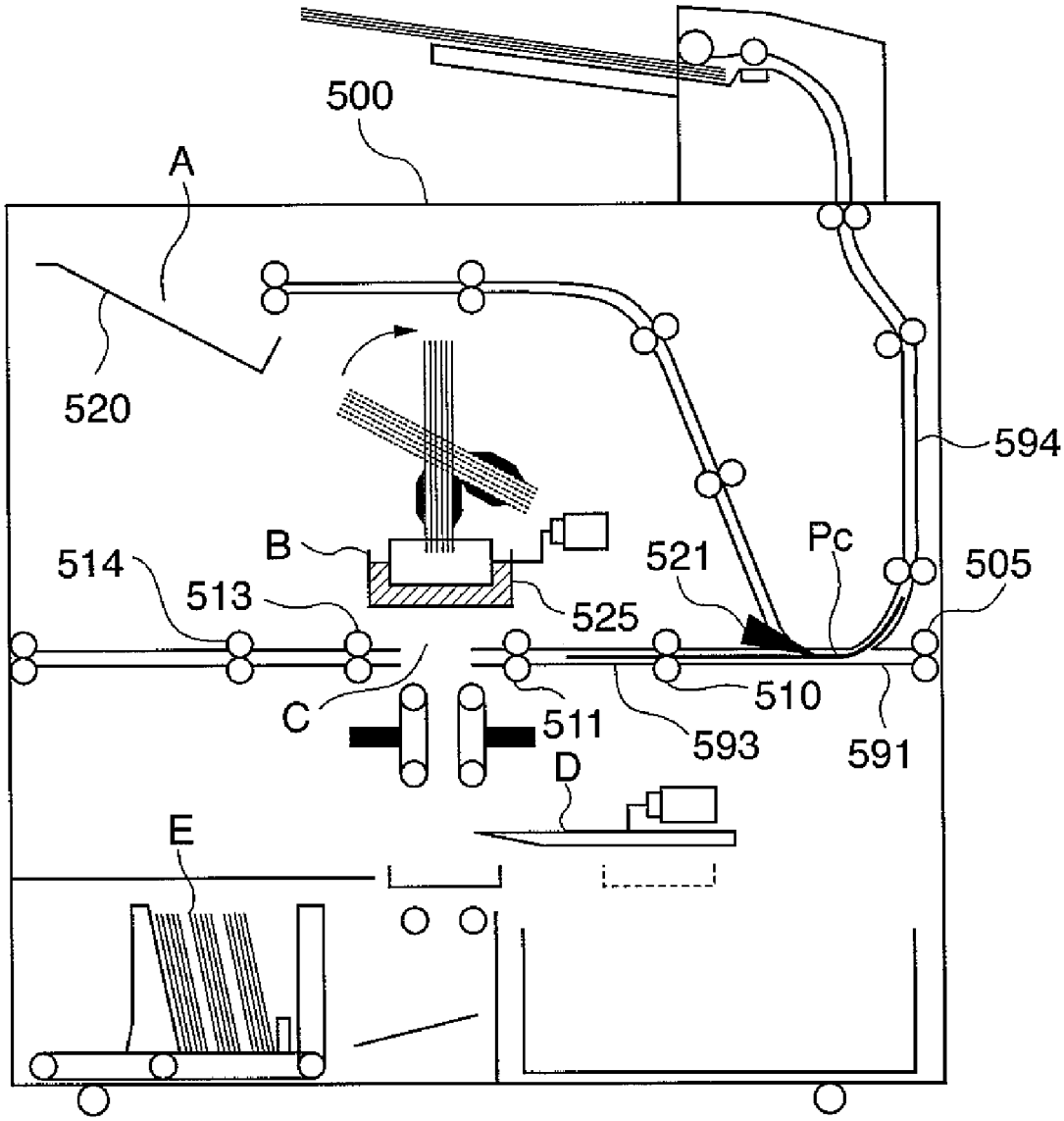
FIG. 9 is a view schematically showing how the sheet bundle is glued and how the cover sheet is conveyed, in the case where the cover sheet is fed from the inserter for bookbinding.

Sheet conveyance in the case where a cover sheet is fed from the inserter 300 for bookbinding will be described with reference to FIGS. 8 and 9. FIGS. 8 and 9 are views schematically showing how a sheet bundle is conveyed and how glue is applied to the sheet bundle, respectively, in the case where a cover sheet is fed from the inserter 300 for bookbinding.

As described hereinbefore with reference to FIGS. 4 to 7, intermediate sheets to form a sheet bundle are sequentially taken in from the image forming apparatus main unit 10 and stacked on the sheet stacking tray 520 to form a sheet bundle. Then, the formed sheet bundle is conveyed to the gluing section B by the gluing gripper 523. In the case where the cover sheet Pc is fed from the inserter 300, an uppermost sheet on the feed tray 310 is fed as a cover sheet Pc by the feed roller 301 during conveyance of the sheet bundle to the gluing section B, as shown in FIG. 8. The cover sheet Pc fed from the inserter 300 is conveyed through the conveying path 594 by the conveying roller pairs 303, 503, and 504 and then guided from the conveying path 594 into the conveying path 593 by the switching flapper 521.

Next, a detailed description will be given of the operation of each section of the glue binding unit 500.

Figure 10:
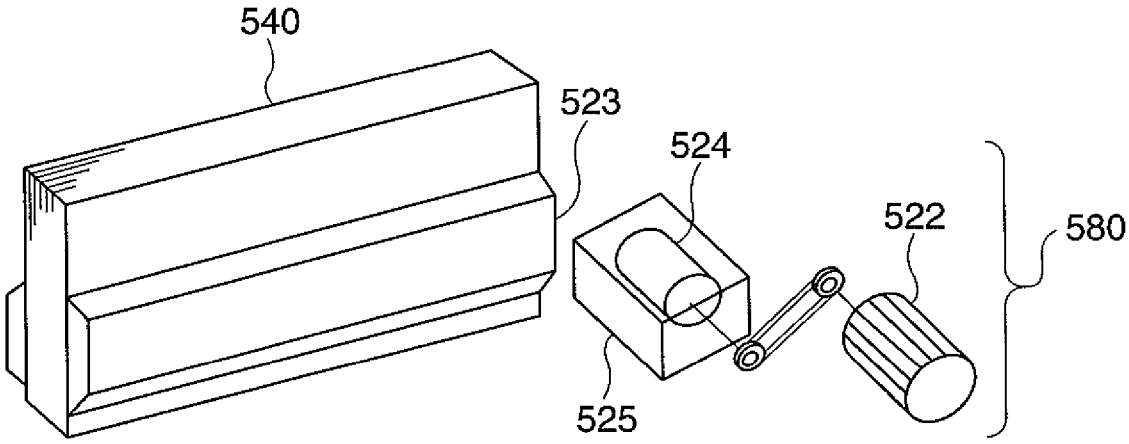
FIG. 10 is a perspective view of the gluing section of the glue binding unit.
Figure 11:
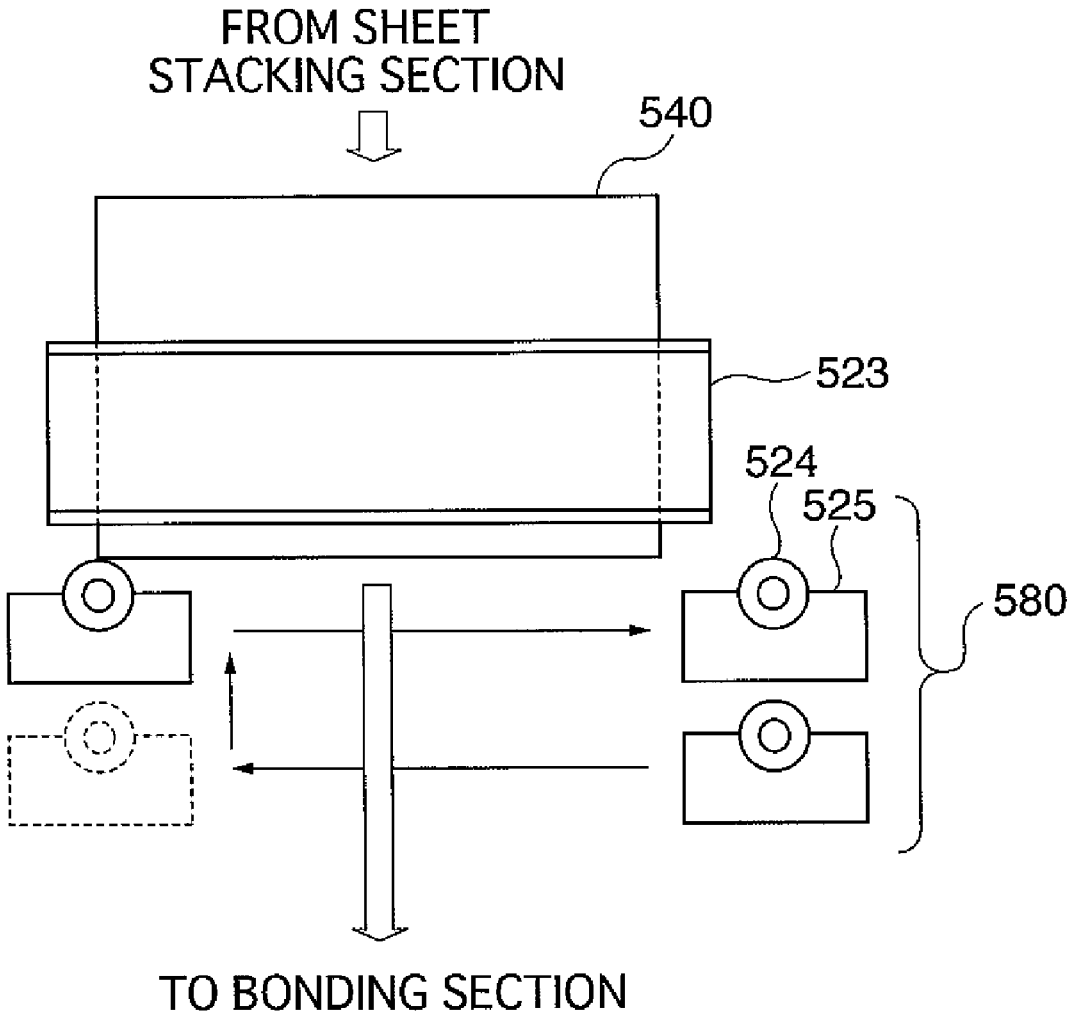
FIG. 11 is an elevation schematically showing the gluing operation of the gluing section.

First, the operation of the gluing section B of the glue binding unit 500 will be described with reference to FIGS. 10 and 11. FIG. 10 is a perspective view of the gluing section B. FIG. 11 is an elevation view schematically showing gluing operation of the gluing section B.

As shown in detail in FIG. 10, the gluing section B is comprised of the gluing gripper 523 for gripping a sheet bundle, the glue container 525 containing glue, the glue-applying roller 524 for applying glue to a sheet bundle, and the glue-applying roller control motor 522. The glue-applying roller 524 is constantly rotated in accordance with rotation of the glue-applying roller control motor 522 in a state soaked in the glue in the glue container 525. The glue container 525, the glue-applying roller 524, and the glue-applying roller control motor 522 cooperate with each other to form a gluing unit 580. The gluing unit 580 is reciprocated by a driving means, not shown, longitudinally along the lower end face of the sheet bundle 540 gripped in a vertical position.

More specifically, as indicated by a leftward arrow in FIG. 11, the gluing unit 580 starts moving from an initial position on a rear side of the glue binding unit 500 and stops in a predetermined position on a front side of the glue binding unit 500. At this time, the gluing unit 580 does not apply glue to the lower end face of the sheet bundle 540. Then, the gluing unit 580, which has been held in stoppage in the predetermined position, moves upward to a position where the glue-applying roller 524 is brought into contact with the lower end face of the sheet bundle 540, as indicated by an upward arrow in FIG. 11. Further, as indicated by a rightward arrow in FIG. 11, the gluing unit 580 is moved from the front side of the glue binding unit 500 to the rear side of the same. At this time, the glue-applying roller 524 is rotated in a state held in contact with the lower end face of the sheet bundle 540, whereby glue is applied thereto.

Next, the bonding section C of the glue binding unit 500 will be described in detail with reference to FIGS. 12 to 19. FIGS. 12 to 19 are longitudinal cross-sectional views each schematically showing a status of operation of the bonding section C.

Figure 12:
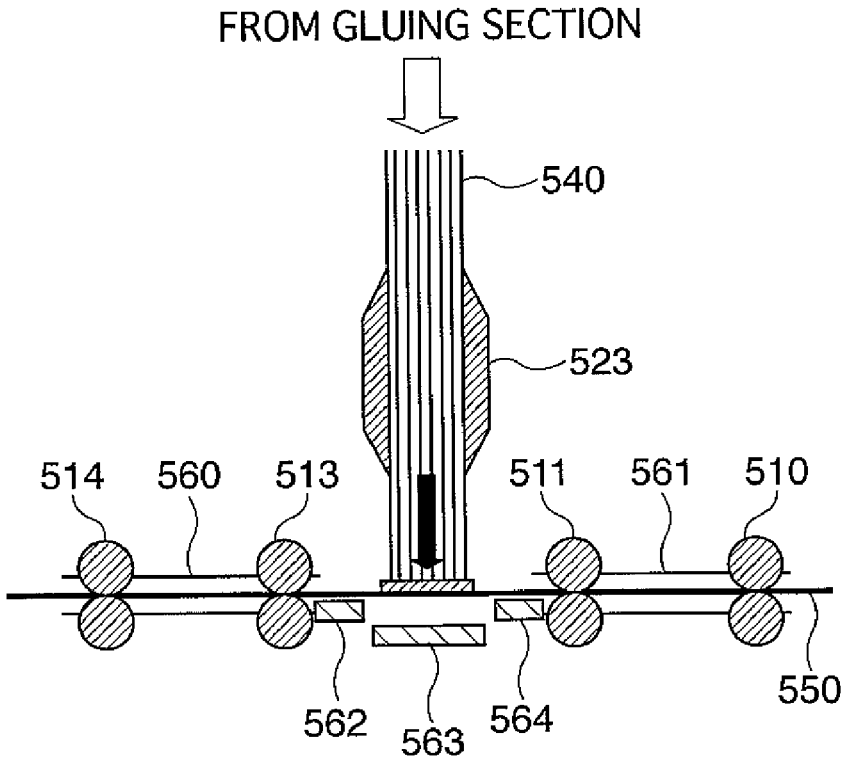
FIG. 12 is a longitudinal cross-sectional view schematically showing a status of operation of a bonding section of the glue binding unit.

As shown in FIG. 12, the bonding section C is provided with conveying guides 560 and 561. The bonding section C is further provided with a pressure member 563 for bringing a cover sheet 550 into pressure contact with a glue-applied surface of a sheet bundle 540, and folding members 562 and 564 for use in wrapping the sheet bundle 540 in the cover sheet 550. The conveying guide 560 is comprised of an upper guide for supporting the upper rollers of the respective conveying roller pairs 513 and 514 and a lower guide for supporting the lower rollers of the respective conveying roller pairs 513 and 514. The upper and lower guides of the conveying guide 560 can be separately moved in a predetermined direction while supporting the associated rollers, respectively. The conveying guide 561 is comprised of an upper guide for supporting the upper rollers of the respective conveying roller pairs 510 and 511 and a lower guide for supporting the lower rollers of the respective conveying roller pairs 510 and 511. The upper and lower guides of the conveying guide 561 can be separately moved in a predetermined direction while supporting the associate rollers, respectively. The cover sheet 550 supplied from the image forming apparatus main unit 10 or the inserter 300 is conveyed to a predetermined position by the conveying roller pairs 510, 511, 513, and 514 and stopped there.

After completion of a gluing operation performed on the sheet bundle 540 by the gluing section B, the gluing gripper 523 gripping the sheet bundle 540 is lowered from the gluing section B to the bonding section C by a driving means, not shown. Then, as shown in FIG. 12, the glue-applied surface of the sheet bundle 540 gripped by the gluing gripper 523 comes into contact with the cover sheet 550 held in a horizontally oriented position by the conveying guides 560 and 561.

Figure 13:
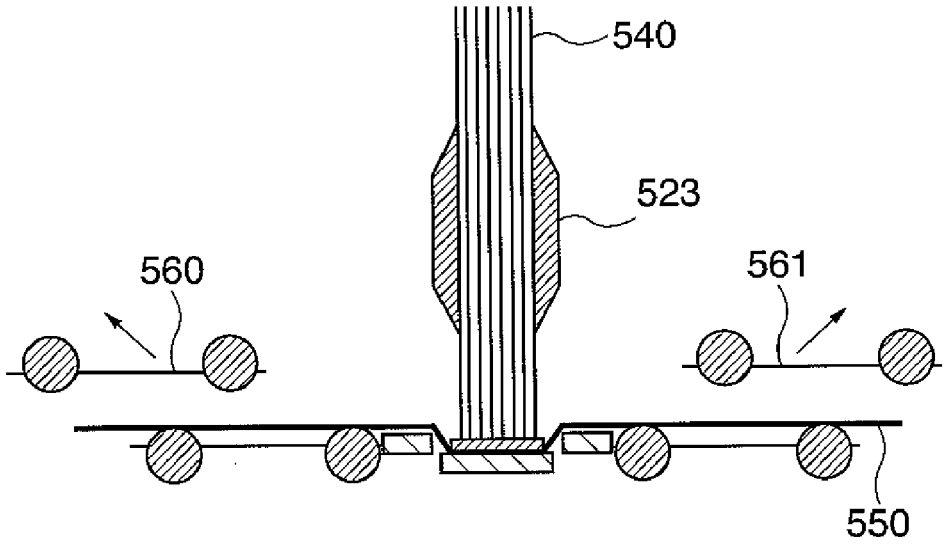
FIG. 13 is a longitudinal cross-sectional view schematically showing a status of operation of the bonding section following the status of operation shown in FIG. 12.

Further, the gluing gripper 523 is lowered to a position where the glue-applied surface of the sheet bundle 540 is pressed against the pressure member 563, whereby a portion of the cover sheet 550 in contact with the glue-applied surface of the sheet bundle 540 is pressed against the pressure member 563. This brings the portion of the cover sheet 550 into pressure contact with the glue-applied surface of the sheet bundle 540 to be bonded thereto. In this case, the upper guides (including the conveying roller pairs 510, 511, 513, and 514) of the conveying guides 560 and 561 are retreated, as shown in FIG. 13, before the sheet bundle 540 is lowered to bring the glue-applied surface thereof into pressure contact with the cover sheet 550, whereby interference with the sheet bundle 540 is prevented.

Figure 14:
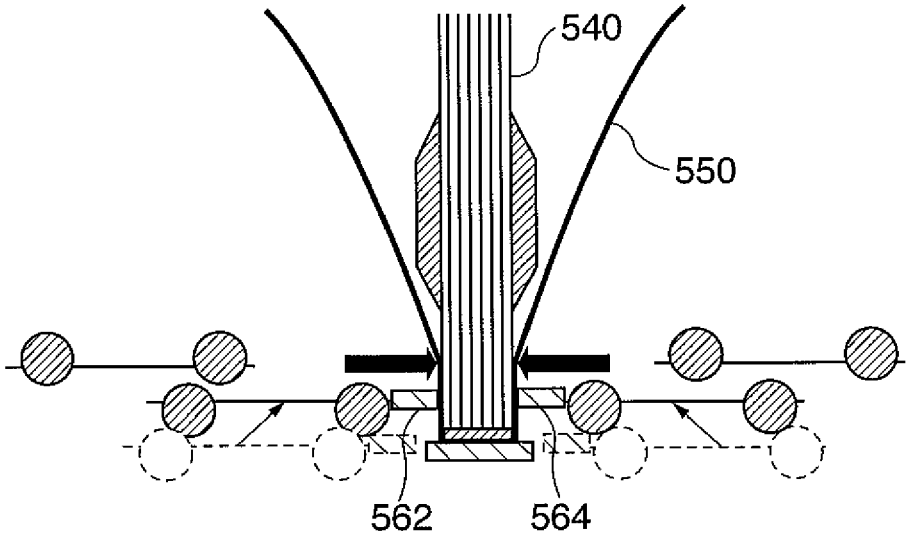
FIG. 14 is a longitudinal cross-sectional view schematically showing a status of operation of the bonding section following the status of operation shown in FIG. 13.

After the cover sheet 550 having been bonded to the sheet bundle 540, the folding members 562 and 564 and the lower guides of the conveying guides 560 and 561 are moved by a driving means, not shown, in an obliquely upward direction, as viewed from the pressure member 563, to be shifted, as shown in FIG. 14, from positions indicated by broken lines in FIG. 14 to positions indicated by solid lines, respectively. As the folding members 562 and 564 are moved obliquely upward, the cover sheet 550 is pushed upward to be curved or bent from the opposite side edges of the glue-applied surface. As a consequence, the cover sheet 550 is folded in a manner wrapping the sheet bundle 540, whereby a book 570 having the sheet bundle 540 wrapped in the cover sheet 550 is obtained (see FIG. 14). This processing is referred to as wrapping processing.

Figure 15:
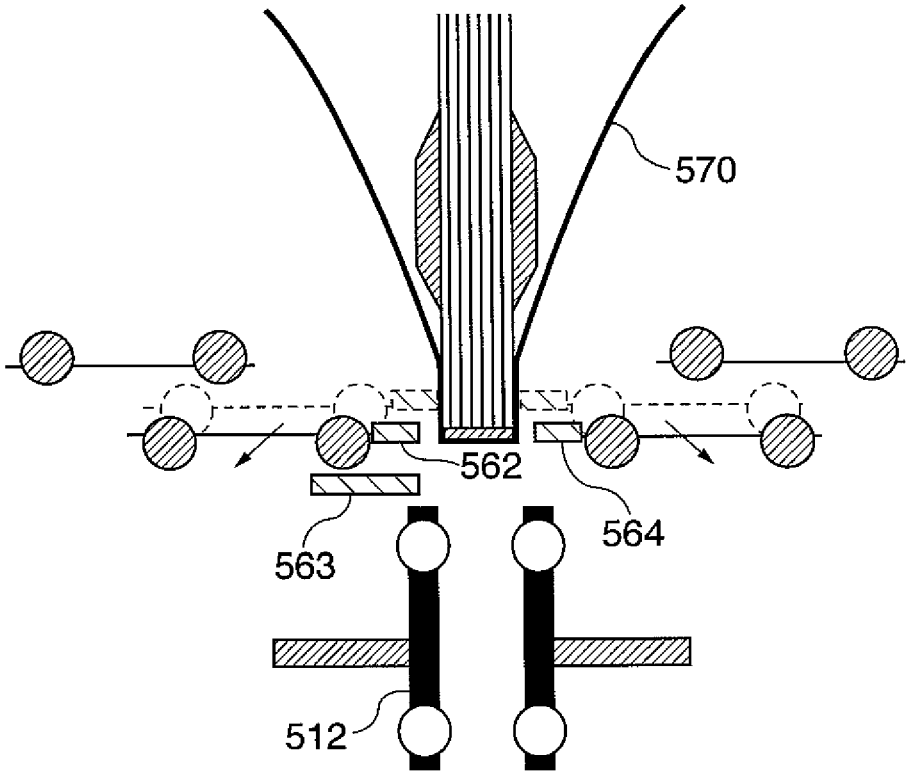
FIG. 15 is a longitudinal cross-sectional view schematically showing a status of operation of the bonding section following the status of operation shown in FIG. 14.

After execution of the wrapping processing on the cover sheet 550, the folding members 562 and 564 and the lower guides of the conveying guides 560 and 561 are moved by the driving means, not shown, as shown in FIG. 15, to be retreated from positions indicated by broken lines in FIG. 15 to positions indicated by solid lines. At the same time, the pressure member 563 is also moved in a horizontal direction by a driving means, not shown. This horizontal movement of the pressure member 563 secures a space for lowering the gluing gripper 523.

Figure 16:
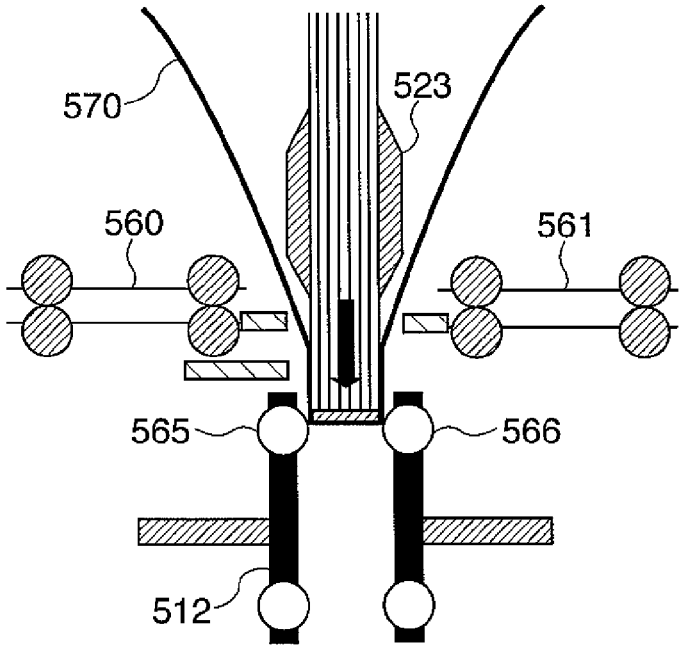
FIG. 16 is a longitudinal cross-sectional view schematically showing a status of operation of the bonding section following the status of operation shown in FIG. 15.

Then, the gluing gripper 523 is further lowered, as shown in FIG. 16, whereby the book 570 is moved downward of the conveying guides 560 and 561 until the lower end thereof comes into contact with pass-to-trim unit rollers 565 and 566.

Figure 17:
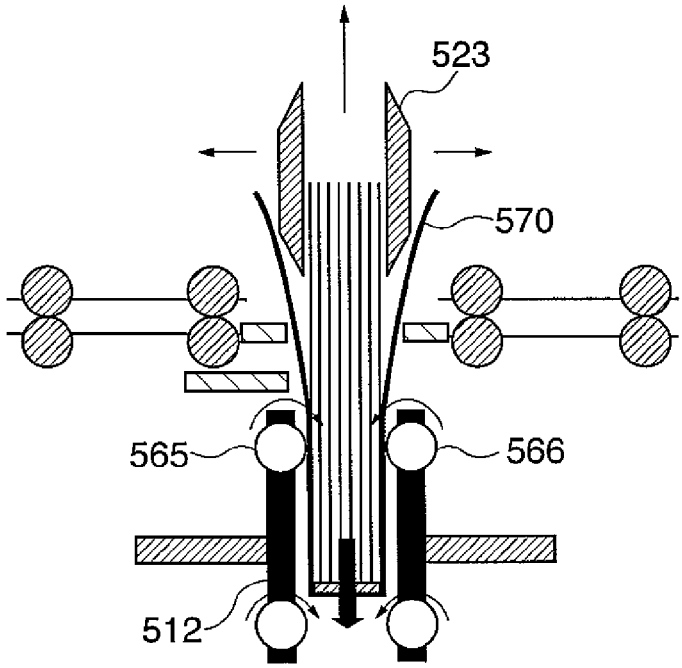
FIG. 17 is a longitudinal cross-sectional view schematically showing a status of operation of the bonding section following the status of operation shown in FIG. 16.
Figure 18:
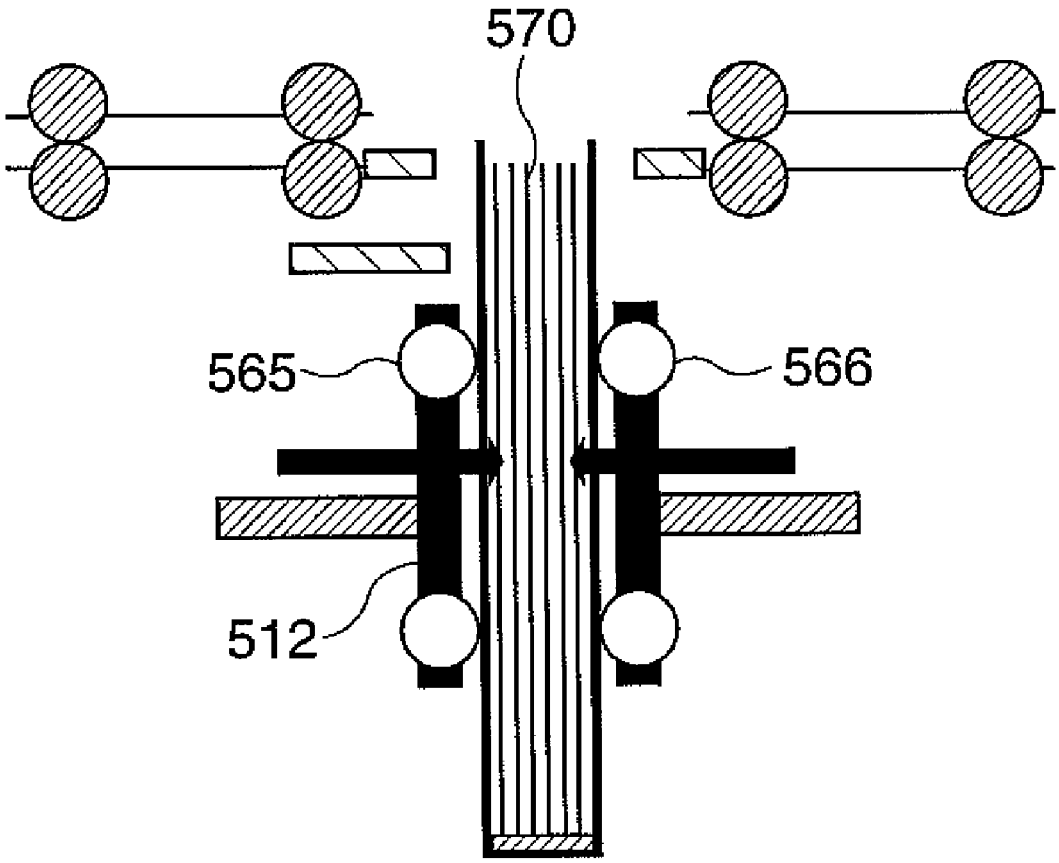
FIG. 18 is a longitudinal cross-sectional view schematically showing a status of operation of the bonding section following the status of operation shown in FIG. 17.

Thereafter, as shown in FIG. 17, the gluing gripper 523 having gripped the book 570 releases the same. Then, the book 570 is conveyed downward by the pass-to-trim unit rollers 565 and 566. The pass-to-trim unit rollers 565 and 566 convey the book 570 to a predetermined position as shown in FIG. 18, and stop the conveyance of the book 570. Then, the trim gripper 512 is driven by the driving means, not shown, to press the book 570 from both the front side thereof and the rear side thereof to thereby grip the book 570.

The trim gripper 512 lowers the book 570 to a predetermined position, i.e. the position of the cutting section D. At this time, the pressure member 563 having moved in the horizontal direction is returned to the position for pressing a bonded portion of a cover sheet.

Figure 22:
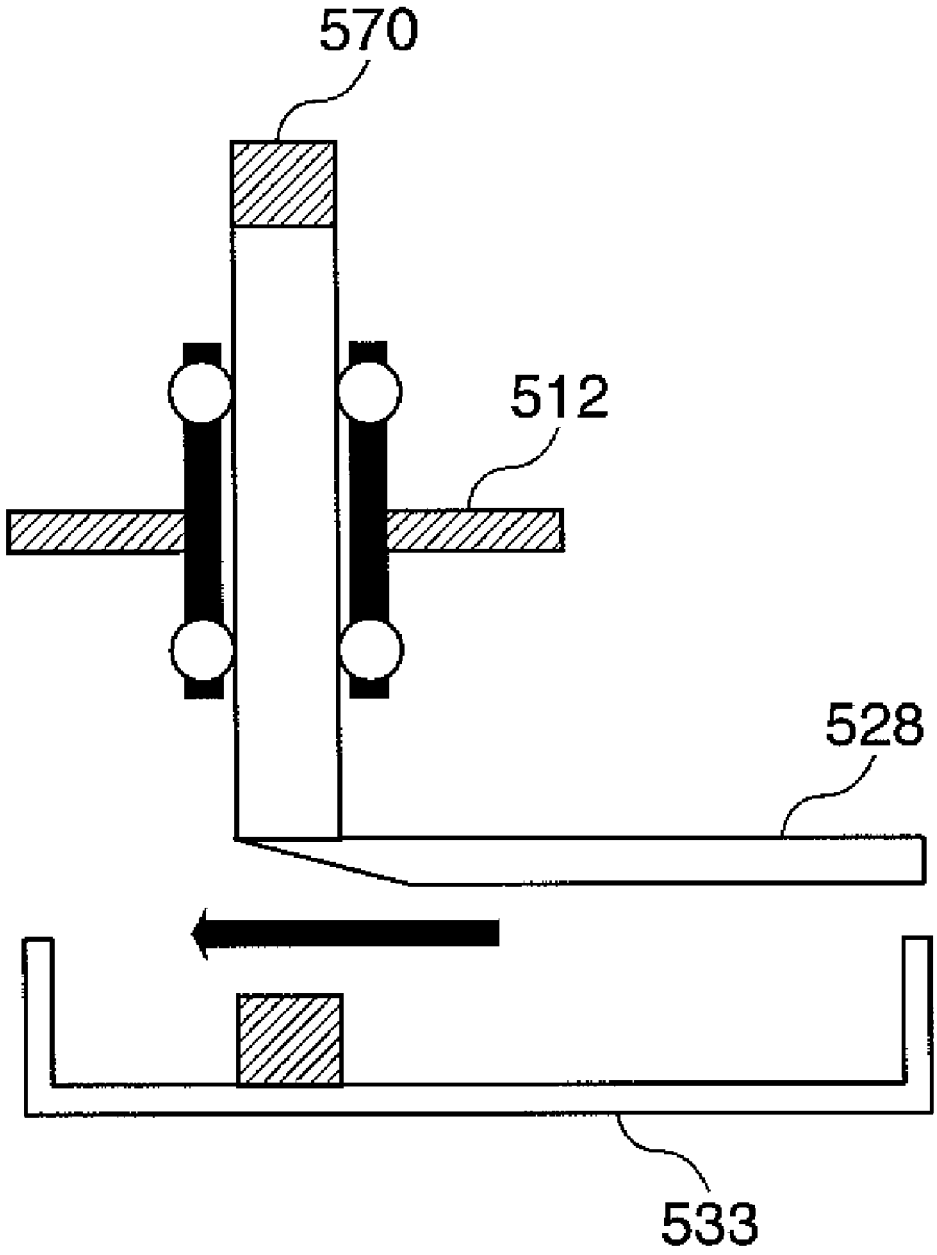
FIG. 22 is a longitudinal cross-sectional view schematically showing a status of operation of the cutting section following the status of operation shown in FIG. 21.
Figure 23:
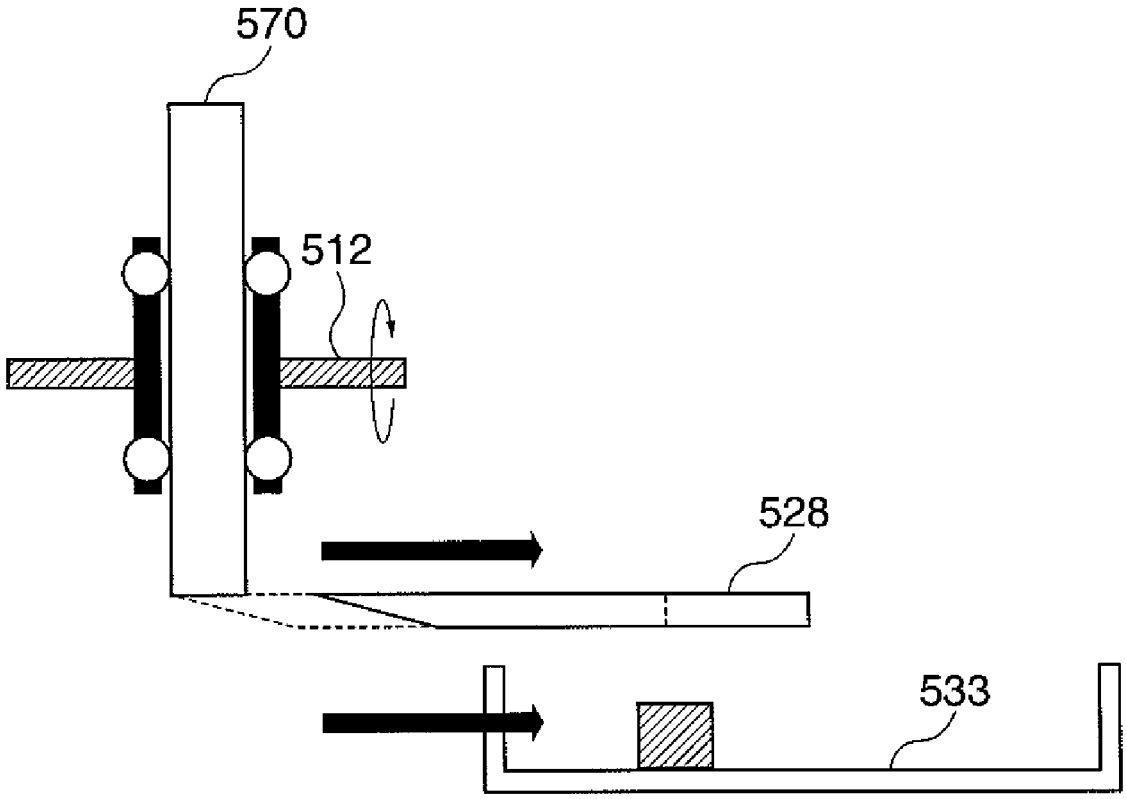
FIG. 23 is a longitudinal cross-sectional view schematically showing a status of operation of the cutting section following the status of operation shown in FIG. 22.
Figure 24:
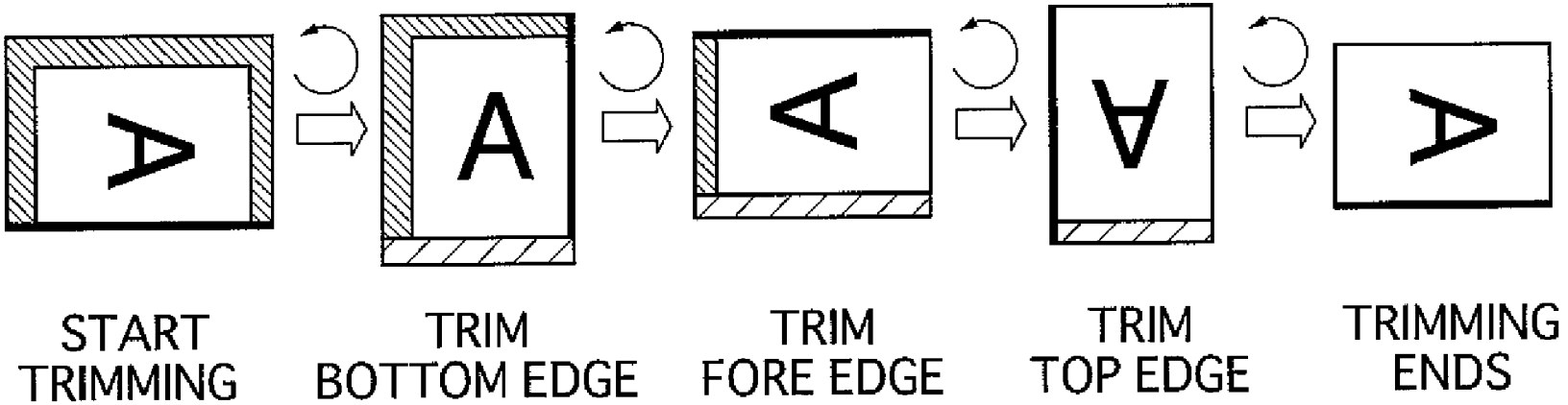
FIG. 24 is a view showing how a trim gripper trims edge portions of a book by rotating the book.
Figure 25:
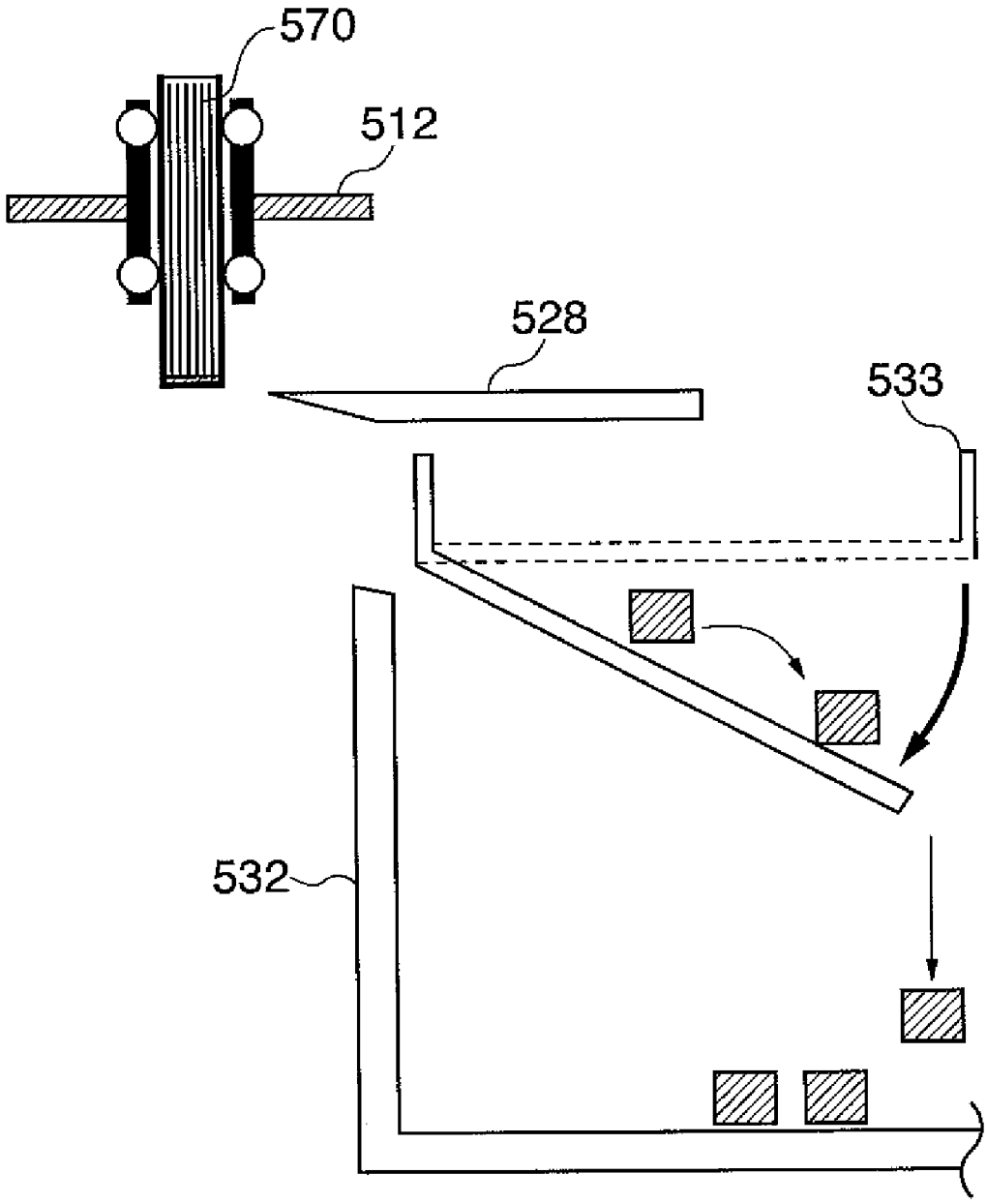
FIG. 25 is a longitudinal cross-sectional view schematically showing an operation for discharging chips.

Next, the operation of the cutting section D of the glue binding unit 500 will be described with reference to FIGS. 20 to 25. FIGS. 20 to 23 are longitudinal cross-sectional views schematically showing the operation of the cutting section D. FIG. 24 is a view schematically showing how the trim gripper 512 trims edge portions of the book 570 while rotating the same. FIG. 25 is a longitudinal cross-sectional view schematically showing an operation for discharging chips.

Figure 19:
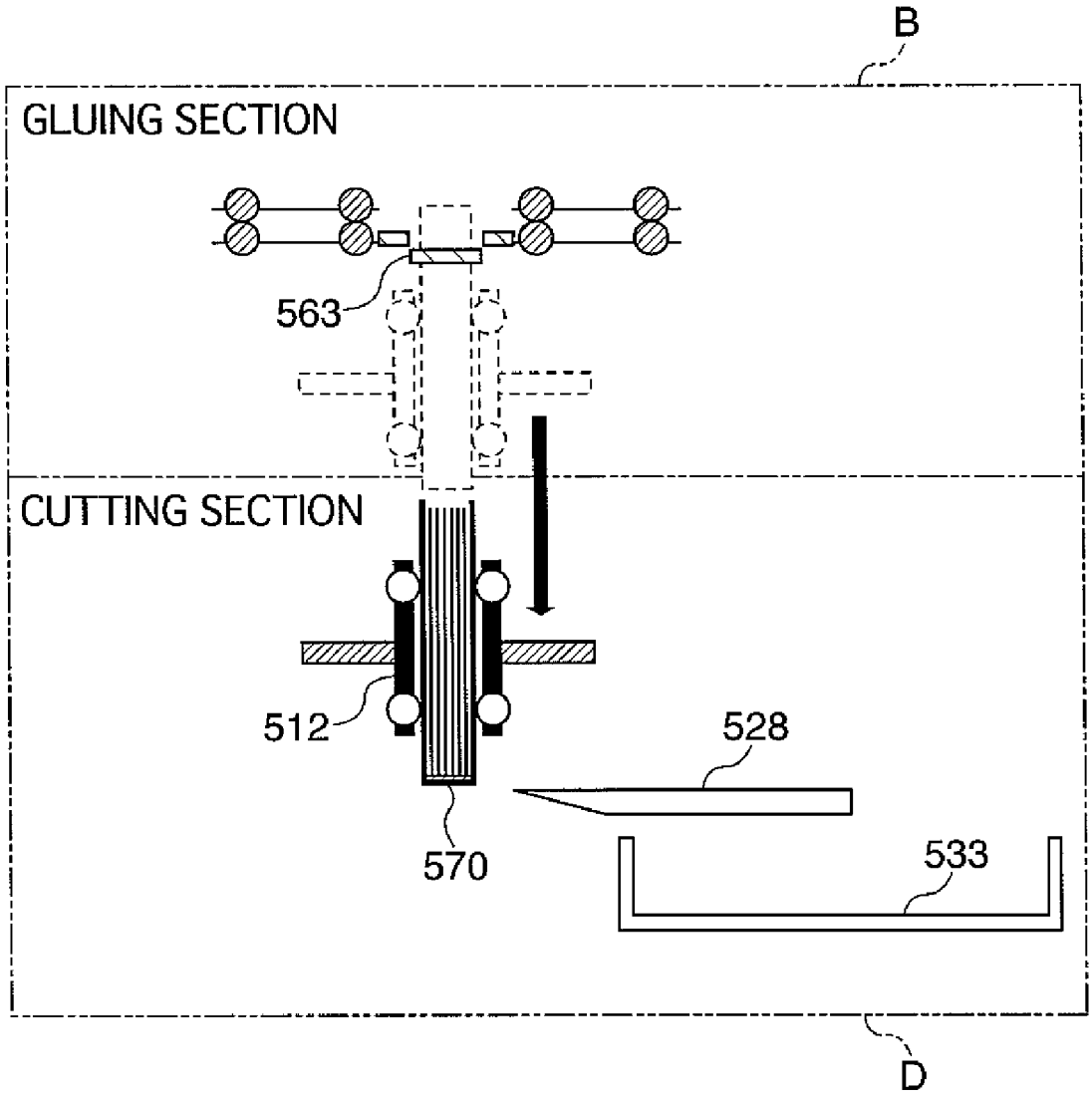
FIG. 19 is a longitudinal cross-sectional view schematically showing a status of operation of the bonding section following the status of operation shown in FIG. 18.
Figure 20:
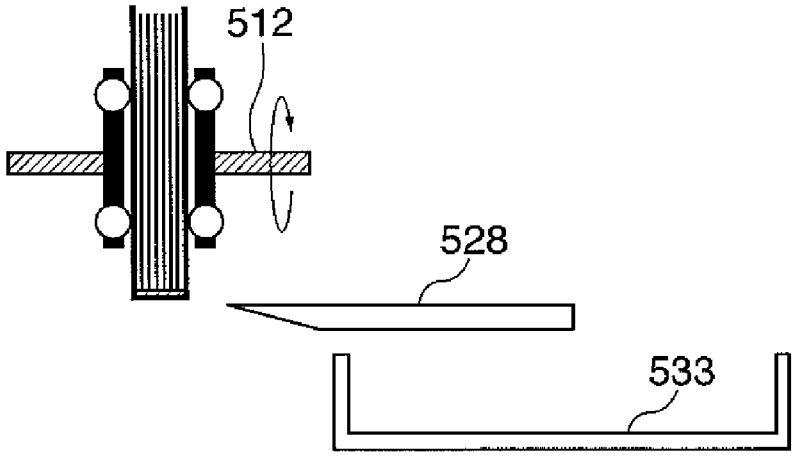
FIG. 20 is a longitudinal cross-sectional view schematically showing a status of operation of a cutting section of the glue binding unit.

As described hereinabove, the book 570 formed by bonding the sheet bundle of intermediate sheets and the cover sheet to each other in the bonding section C is moved to the cutting section D by the trim gripper 512 (see FIG. 19). In the cutting section D, the trim gripper 512, the cutter 528, and the chip receiving box 533 operate in an interlocked fashion to trim the edge portions of the book 570, as shown in FIG. 20.

Figure 21:
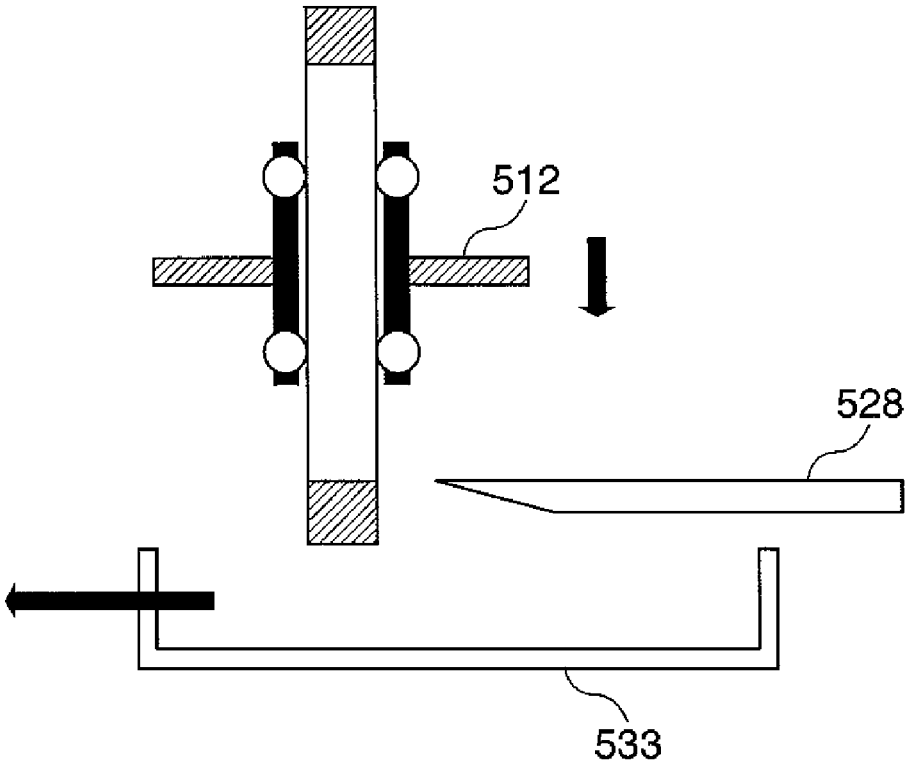
FIG. 21 is a longitudinal cross-sectional view schematically showing a status of operation of the cutting section following the status of operation shown in FIG. 20.

First, as shown in FIG. 21, the chip receiving box 533 is moved to a position below the book 570 before trimming by the cutter 528 is started. Then, the cutter 528 trims one side of the book 570 by moving forward. During this operation, chips from the book 570 are received in the chip receiving box 533 waiting below the book 570, as shown in FIG. 22. Thereafter, the cutter 528 is moved to its retreat position as shown in FIG. 23. At the same time, the chip receiving box 533 is also moved to its retreat position. In FIGS. 21 to 23, the book 570 is positioned such that a cover spine thereof faces the viewer.

As shown in FIG. 24, the above-described trimming operation is performed on the edge portions of the book 570 corresponding to the bottom side, the fore edge, and the top side, respectively. First, the trim gripper 512 gripping the book 570 having undergone the bonding operation with its spine-side edge portion facing downward is rotated by $\pi/2$ (rad) in a counterclockwise direction, as viewed in FIG. 24, whereby the orientation of the book 570 is turned by $\pi/2$ (rad). As a consequence, the bottom side of the book 570 faces downward to be trimmed.

Then, the trim gripper 512 is rotated by $\pi/2$ (rad) in the counterclockwise direction, whereby the fore edge of the book 570 faces downward to be trimmed. Further, the trim gripper 512 is rotated by $\pi/2$ (rad), whereby the top side of the book 570 faces downward to be trimmed.

When the edge portions of the book 570 other than the spine-side edge portion are thus trimmed, the trimmed book 570 is further rotated by $\pi/2$ (rad) by the trim gripper 512 so as to be conveyed to the book discharging section E with its cover spine facing downward.

The chip receiving box 533 moves between its retreat position for retreating after completion of trimming operation and its chip receiving position for receiving chips during trimming operation. The retreat position of the chip receiving box 533 is located above the chip waste box 532. Further, as shown in FIG. 25, the chip receiving box 533 has a bottom plate configured to be openable. When the chip receiving box 533 is moved to its retreat position, the bottom plate of the chip receiving box 533 is opened, whereby chips from the chip receiving box 533 are received in the chip waste box 532.

Next, the book discharging section E will be described in detail with reference to FIGS. 26 to 29. FIGS. 26 to 29 are longitudinal cross-sectional views schematically showing the operation of the book discharging section E.

Figure 26:
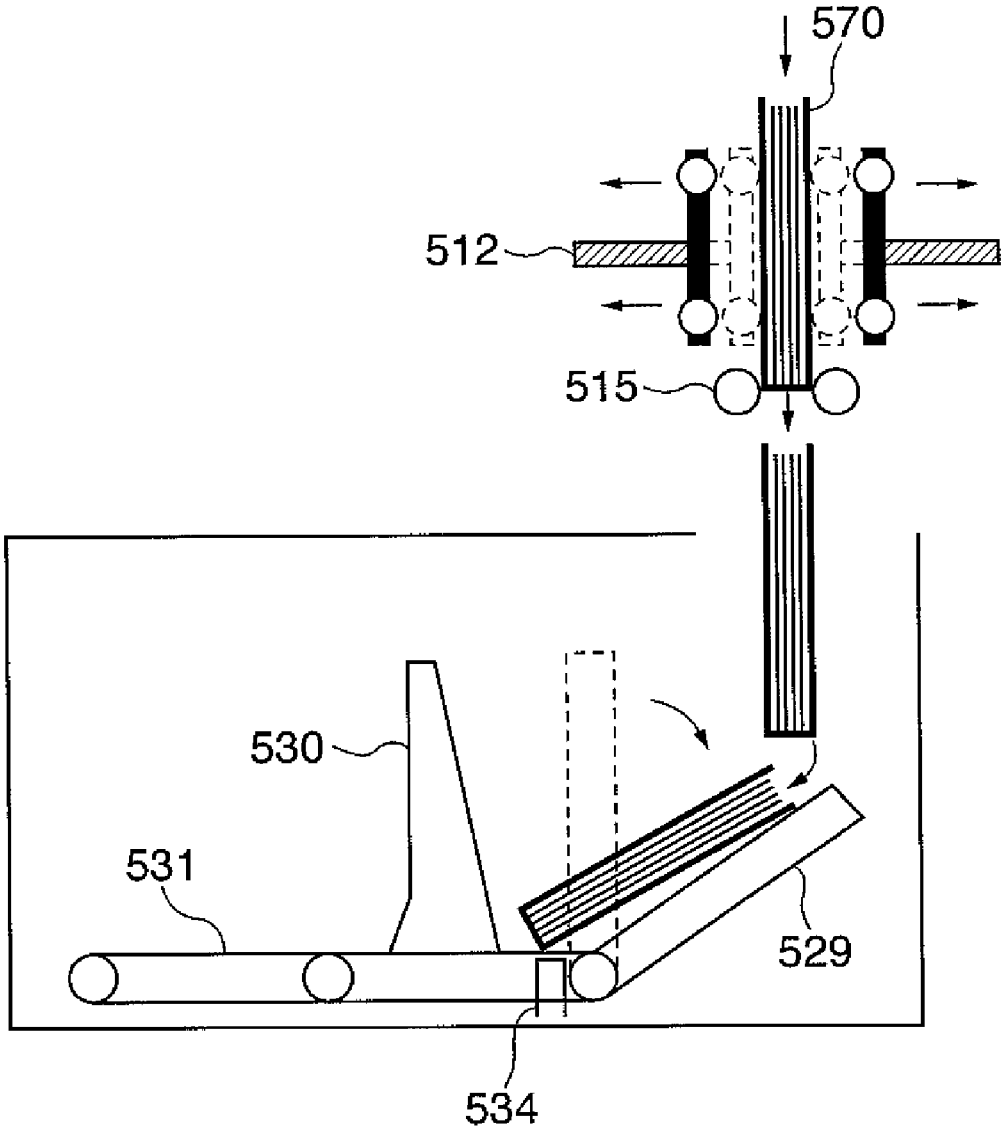
FIG. 26 is a longitudinal cross-sectional view schematically showing an operation of a book discharging section of the glue binding unit.
Figure 27:
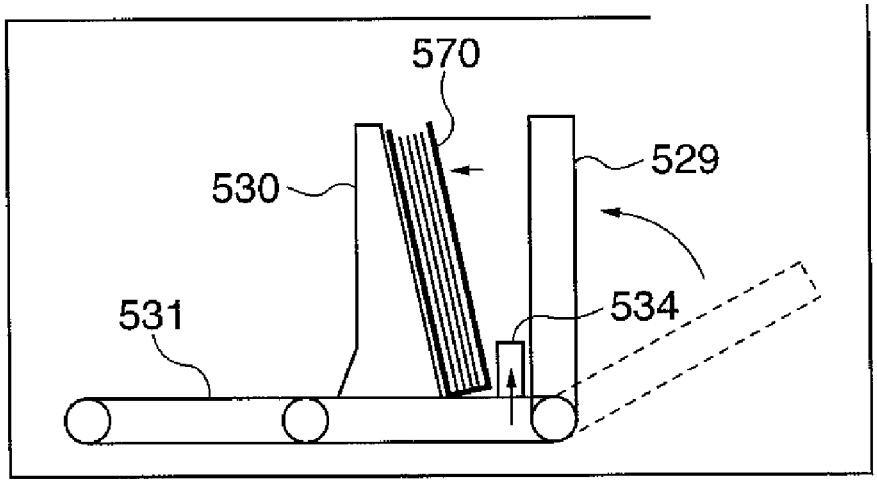
FIG. 27 is a longitudinal cross-sectional view schematically showing an operation of the book discharging section following the operation shown in FIG. 26.

As shown in FIG. 26, the book 570 having been gripped by the trim gripper 512 is received by the inlet roller pair 515 to be conveyed into the book discharging section E. The book 570 conveyed by the inlet roller pair 515 is temporarily loaded on the loading plate 529. The loading plate 529 pivotally moves to an upright position as shown in FIG. 27. This causes the book 570 loaded on the loading plate 529 to be supported in a manner standing against the book support plate 530.

Figure 28:
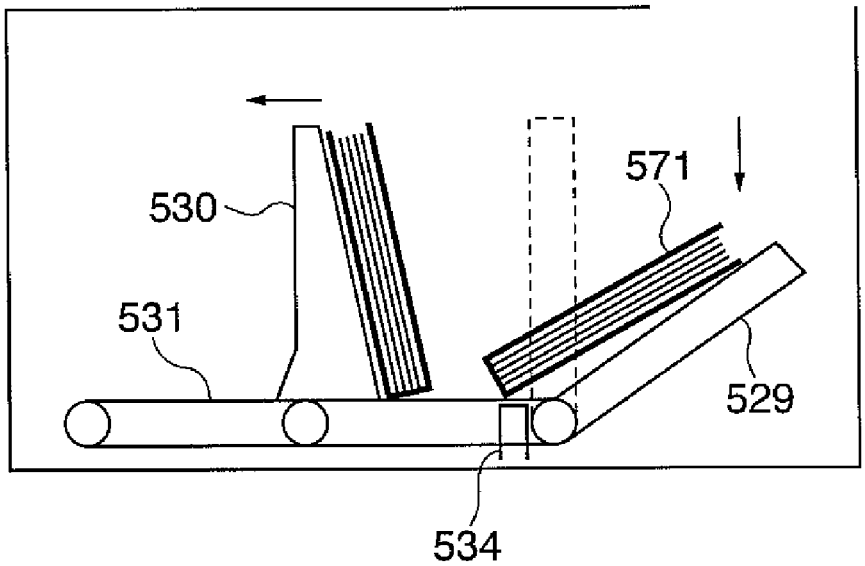
FIG. 28 is a longitudinal cross-sectional view schematically showing an operation of the book discharging section following the operation shown in FIG. 27.
Figure 29:
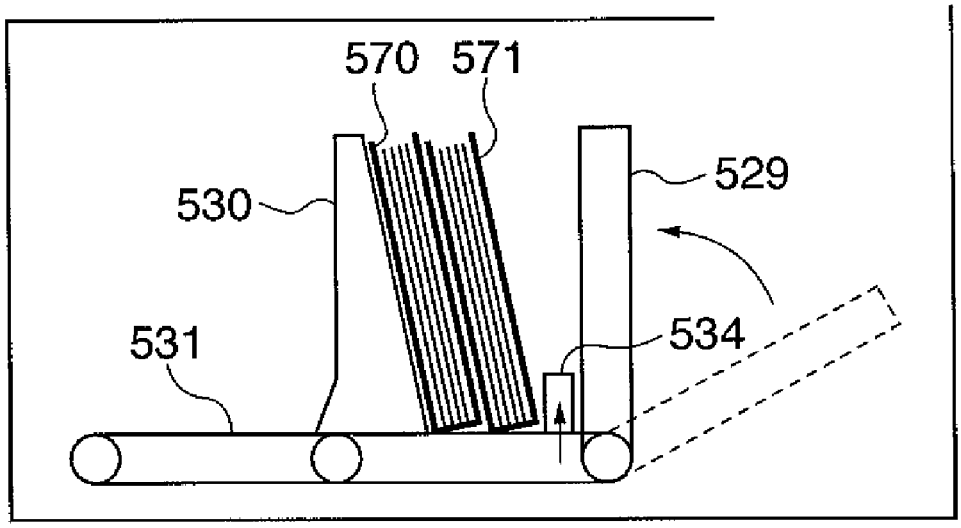
FIG. 29 is a longitudinal cross-sectional view schematically showing an operation of the book discharging section following the operation shown in FIG. 28.

At this time, the book discharge stabilizing plate 534 positioned below the discharge conveyor belt 531 is moved upward by a driving means, not shown, as shown in FIG. 27, whereby the book 570 is stably supported by the book support plate 530 and the book discharge stabilizing plate 534. Thereafter, the book support plate 530 is moved leftward by the discharge conveyor belt 531, as shown in FIG. 28, so as to secure a discharge space for a next book 571 to be conveyed. Then, the same operation as described above is performed on the next book 571. As a consequence, the book 571 is supported next to the book 570, as shown in FIG. 29.

The books thus supported in a manner standing against the book support plate 530 can be taken out from the unit by the user.

Figure 30:
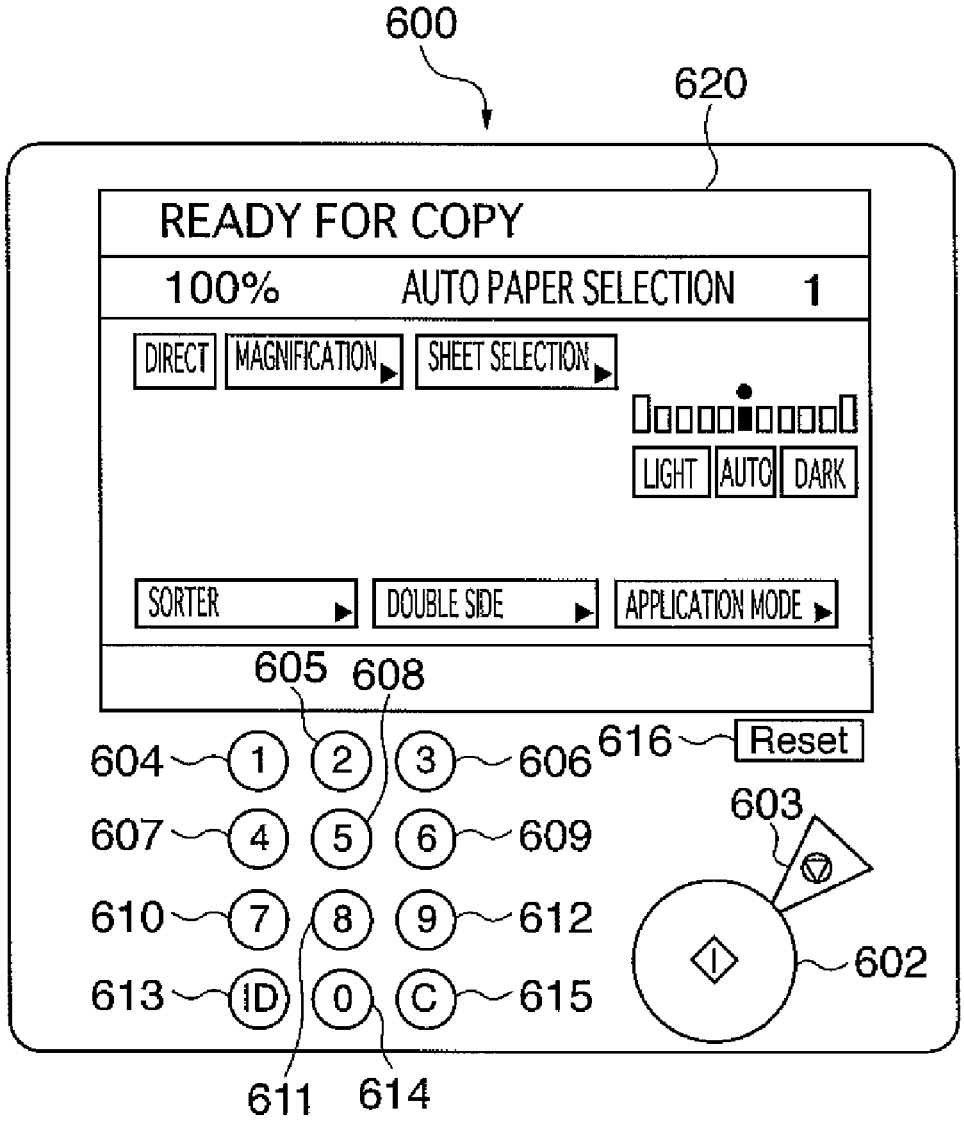
FIG. 30 is a view showing the appearance of an operating and display unit of the image forming apparatus in FIG. 1.

Next, the operating and display unit 600 of the image forming apparatus in FIG. 1 will be described in detail with reference to FIG. 30. FIG. 30 is a view showing the appearance of the operating and display unit 600.

As shown in FIG. 30, on the operating and display unit 600, there are arranged a start key 602, a stop key 603, a ten-key numeric keypad including keys 604 to 612 and 614, an ID key 613, a clear key 615, a reset key 616, and so forth. The start key 602 is used to start image forming operation, and the stop key 603 is used to interrupt the image forming operation. The keys 604 to 612 and 614 are used to set input numbers. Further, on an upper part of the operating and display unit 600, there is disposed a liquid crystal display 620 having a touch panel formed thereon. Soft keys can be displayed on the screen of the liquid crystal display 620.

According to the present embodiment, it is possible to carry out post-processing modes including "the bookbinding mode" using the glue binding unit 500. These modes are set or configured by input operations from the operating and display unit 600.

Figure 31:
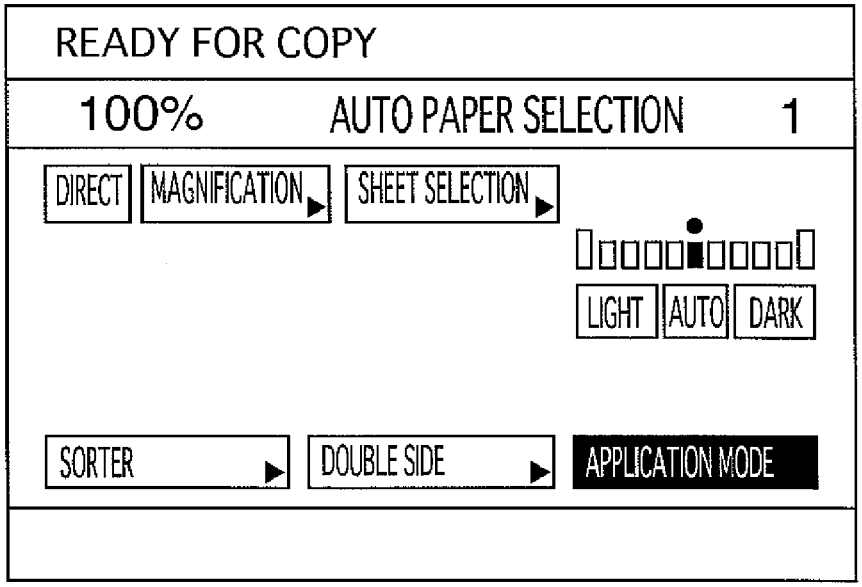
FIG. 31 is a view illustrating an initial screen displayed on the operating and display unit.
Figure 32:
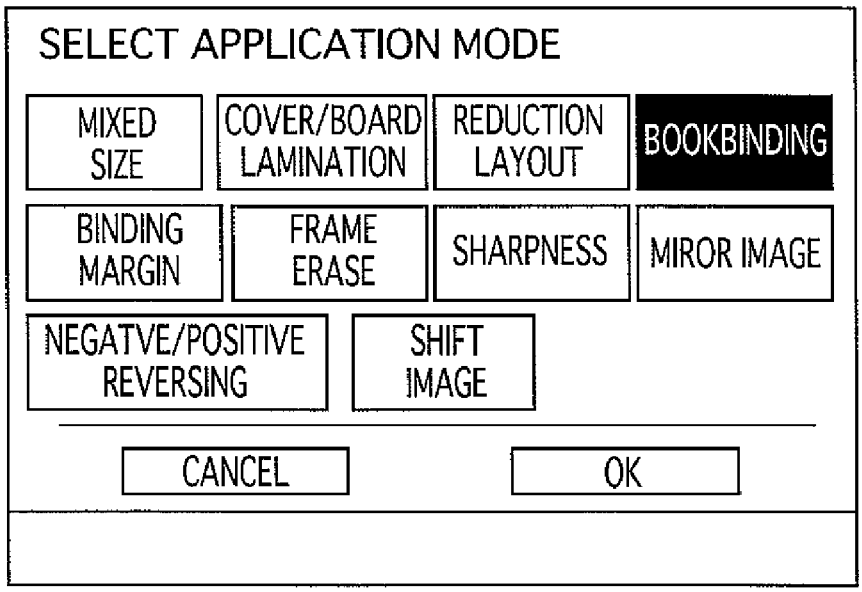
FIG. 32 is a view illustrating an application mode selecting screen.
Figure 33:
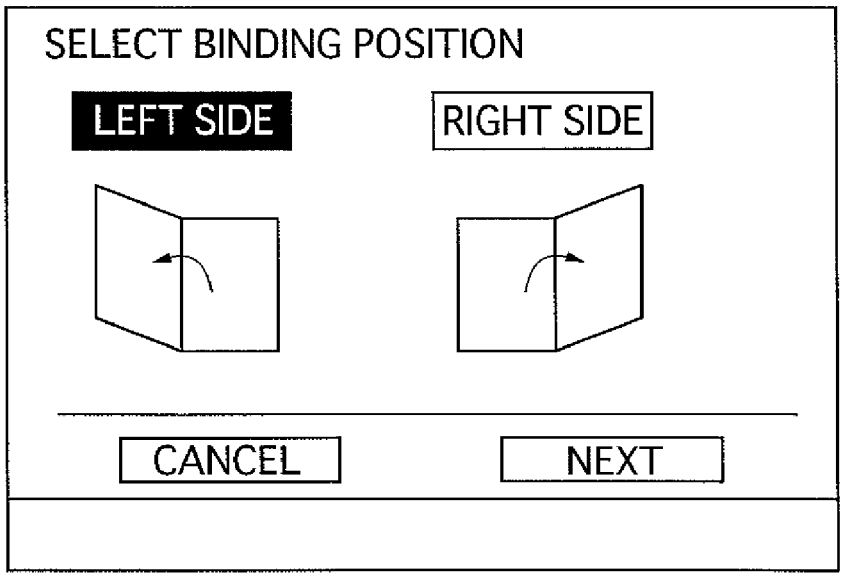
FIG. 33 is a view illustrating a binding position-selecting screen.
Figure 34:
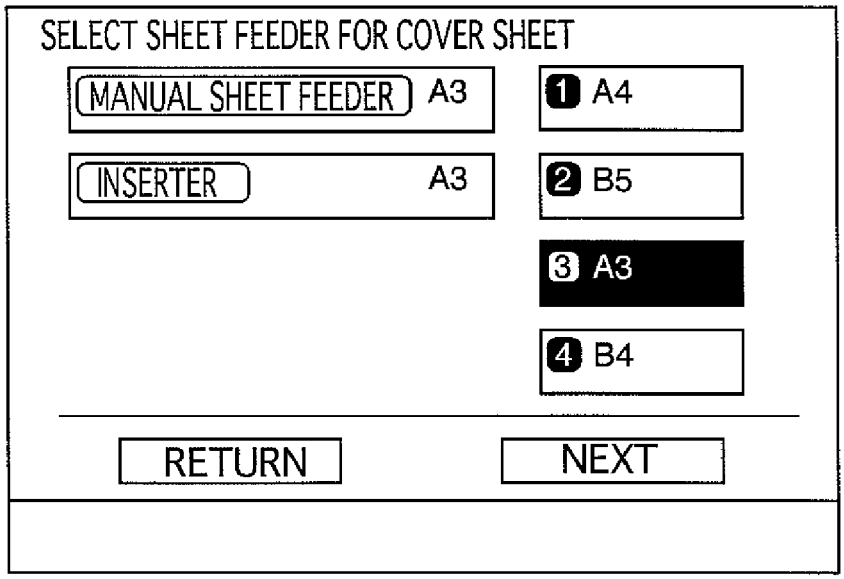
FIG. 34 is a view illustrating a cover sheet feeder-selecting screen.
Figure 35:
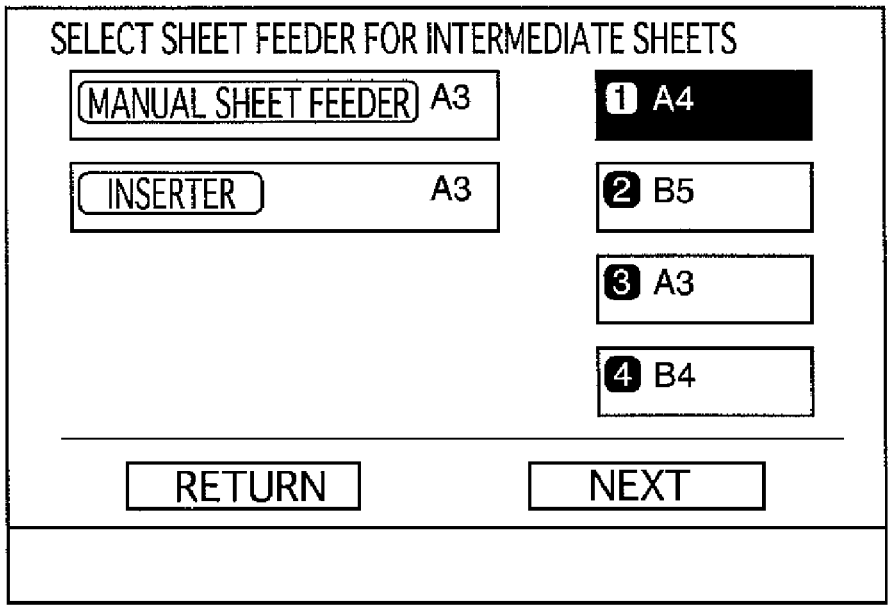
FIG. 35 is a view illustrating an intermediate sheet feeder-selecting screen.
Figure 36:
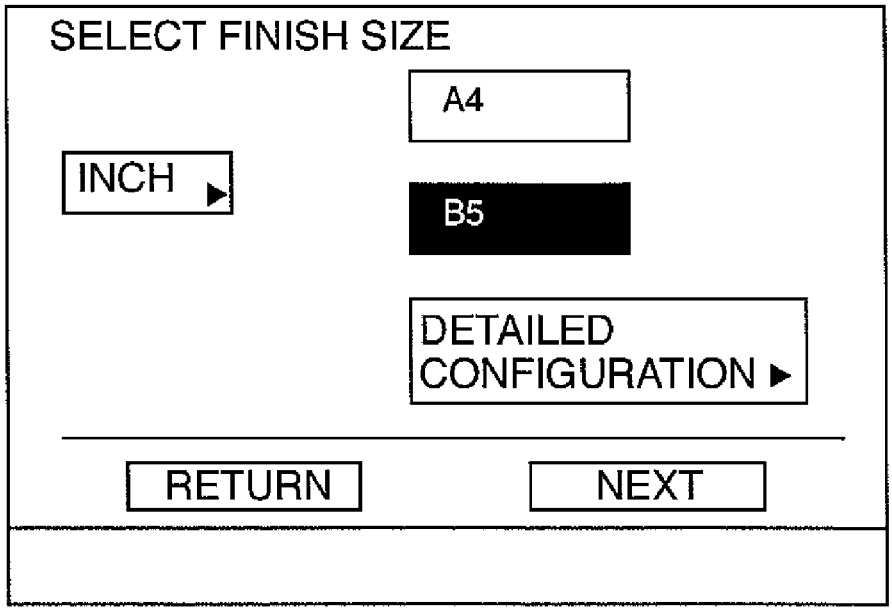
FIG. 36 is a view illustrating a finish size-selecting screen.
Figure 37:
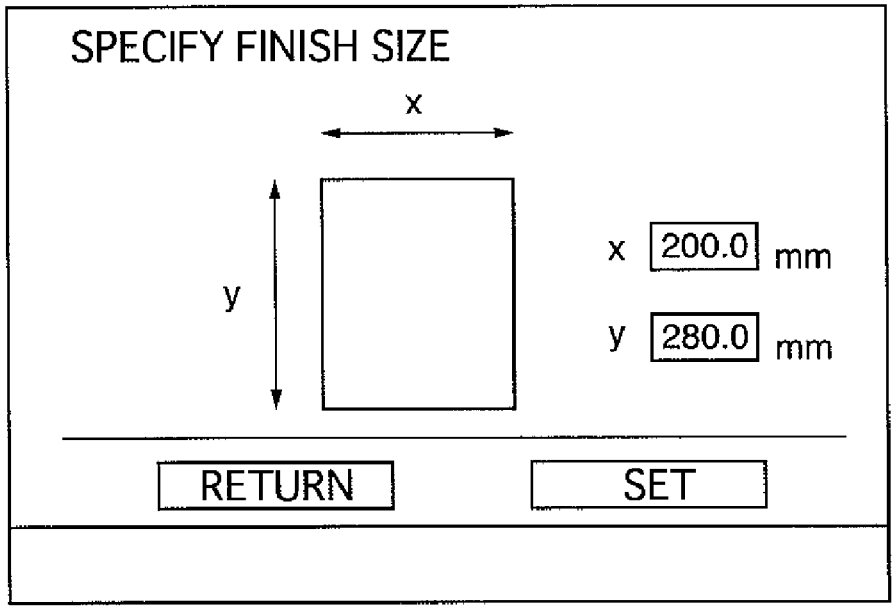
FIG. 37 is a view illustrating a finish size-specifying screen.
Figure 38:
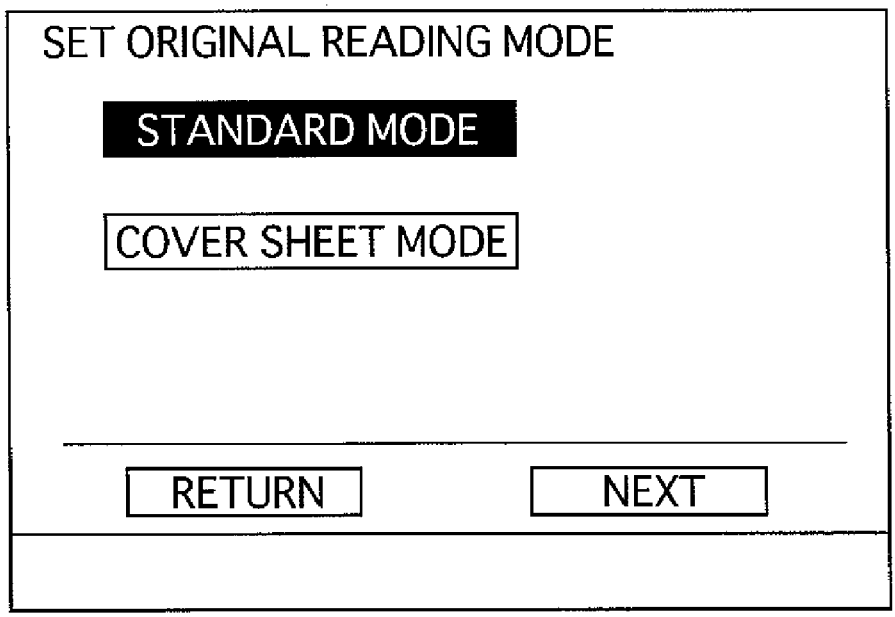
FIG. 38 is a view illustrating an original reading mode setup screen.
Figure 41:
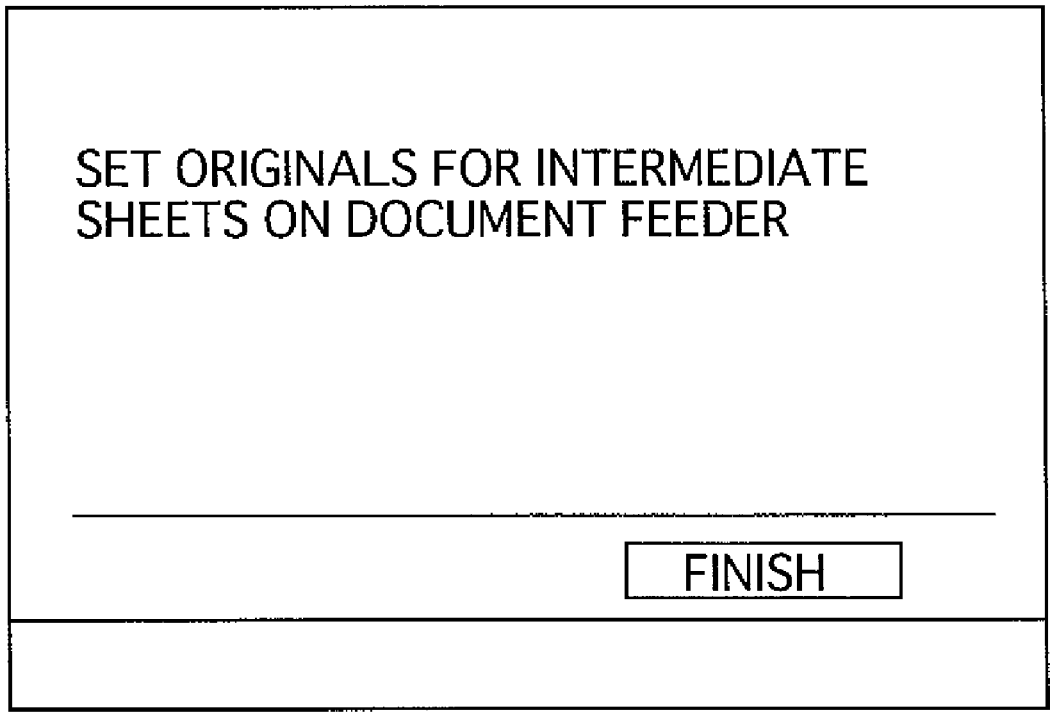
FIG. 41 is a view illustrating a screen prompting the user to set intermediate sheets.
Figure 42A:
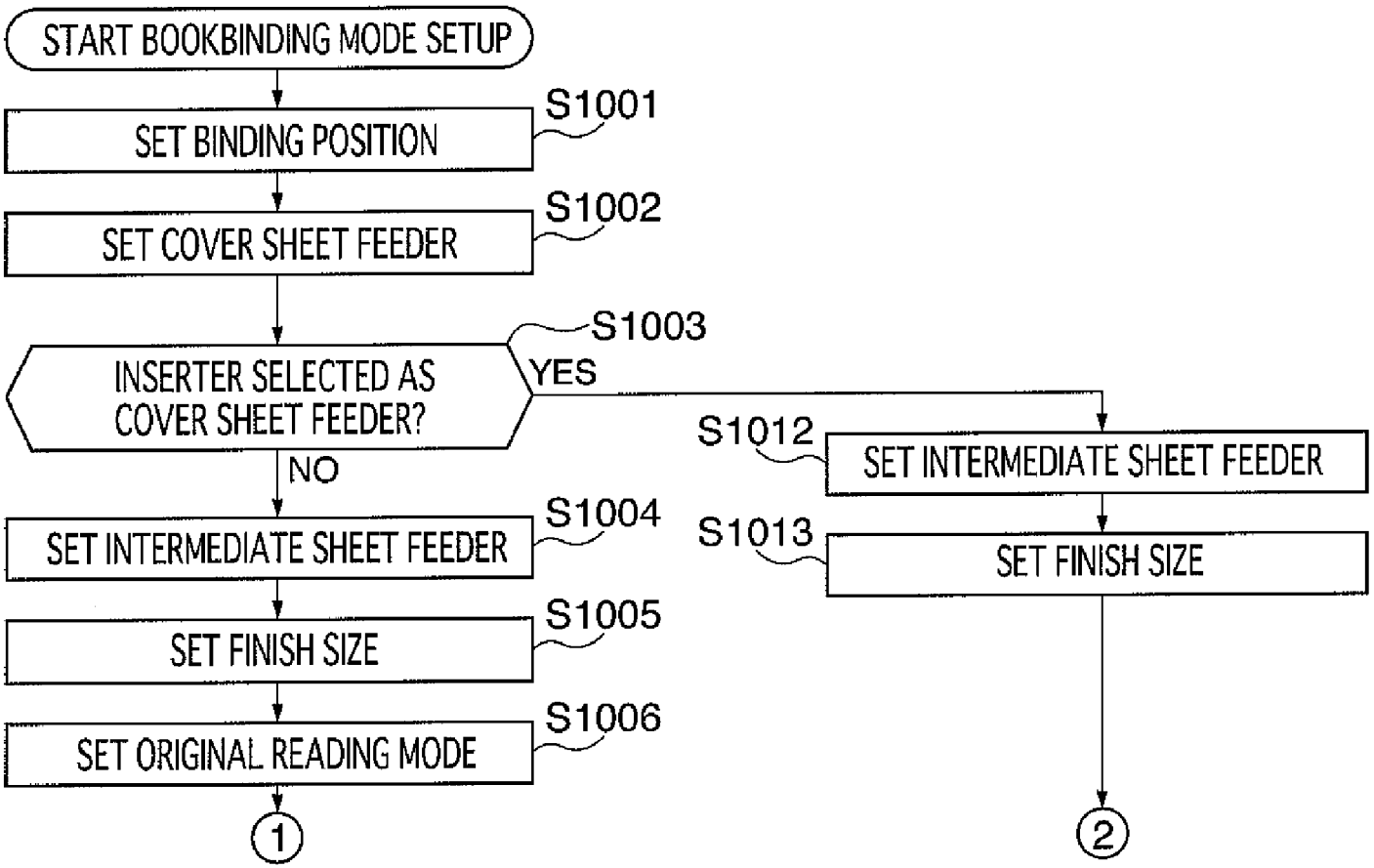
FIG. 42A is a part of a flowchart of a bookbinding mode setup process.
Figure 42B:
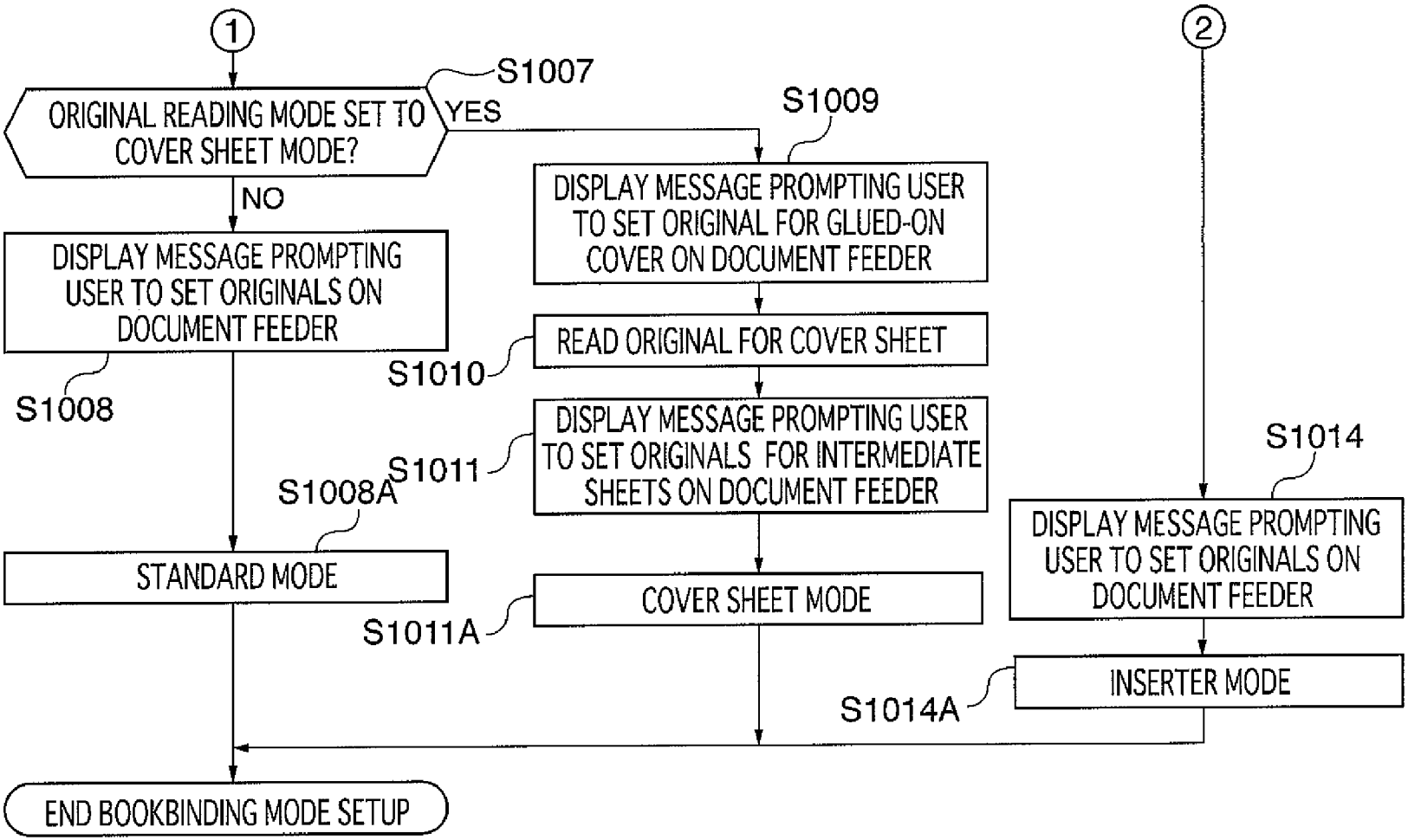
FIG. 42B is a continued part of the flowchart shown in FIG. 42A.

Next, configuration of the bookbinding mode will be described with reference to FIGS. 31 to 42B. FIG. 31 is a view illustrating an initial screen displayed on the operating and display unit 600. FIG. 32 is a view illustrating an application mode selecting screen. FIG. 33 is a view illustrating a binding position-selecting screen. FIG. 34 is a view illustrating a cover sheet feeder-selecting screen. FIG. 35 is a view illustrating an intermediate sheet feeder-selecting screen. FIG. 36 is a view illustrating a finish size-selecting screen. FIG. 37 is a view illustrating a finish size-specifying screen. FIG. 38 is a view illustrating an original reading mode setup screen. FIG. 39 is a view illustrating a screen prompting the user to set originals in a document feeder. FIG. 40 is a view illustrating a screen prompting the user to set an original for a glued-on cover and cause the original to be read. FIG. 41 is a view illustrating a screen prompting the user to set intermediate sheets. FIGS. 42A and 42B are a flowchart of a bookbinding mode setup process. The process shown in FIGS. 42A and 42B is executed by the CPU circuit section 150.

The initial screen illustrated in FIG. 31 by way of example is displayed on the liquid crystal display 620 of the operating and display unit 600. When an "application mode" key as a soft key is pressed on the initial screen, the application mode selecting screen illustrated in FIG. 32 by way of example is displayed on the liquid crystal display 620. On the application mode selecting screen, there are displayed a list of selectable application modes. When a "bookbinding" soft key is selected from the list, the bookbinding mode setup process shown in FIGS. 42A and 42B is started.

In the setup process, first, the binding position of a product is set (step S1001). In this step, the screen illustrated in FIG. 33 by way of example is displayed so as to enable the user to designate one of "right side" and "left side" as a desired binding position of the product. The "right-side binding" is a way of binding a book such that the page number increments from a right side page number to a left side page number when the book is opened, while the "left-side binding" is a way of binding a book such that the page number increments from a left side page number to a right side page number. On the present screen, one of soft keys "right side" and "left side" is pressed by the user, and then a "next" soft key is pressed so as to confirm the selection. Thus, the binding position of the product corresponding to the pressed soft key is set.

Then, a sheet feeder is set for feeding a glued-on cover (step S1002). In this step, the screen illustrated in FIG. 34 by way of example is displayed to enable the user to designate a sheet feeder for feeding a glued-on cover. On the screen, there are displayed soft keys associated with the manual sheet feeder, the sheet feed cassettes, and the inserter, respectively, for selection as a glued-on cover feeder. Further, the size of a feedable sheet is attached to each of the soft keys. On the present screen, a soft key associated with the manual sheet feeder, one of the sheet feed cassettes, or the inserter is pressed, and then a "next" soft key is pressed to confirm the selection. Thus, the sheet feeder associated with the pressed soft key is set to the sheet feeder for feeding the cover sheet.

Then, it is determined whether or not the set sheet feeder is the inserter (step S1003). If it is determined in this step that the set sheet feeder is not the inserter, a sheet feeder is set for feeding intermediate sheets (step S1004). In the setting of an intermediate sheet feeder, the screen illustrated in FIG. 35 by way of example is displayed to enable the user to designate a sheet feeder for feeding intermediate sheets. On the screen, there are displayed soft keys associated with the manual sheet feeder, the sheet feed cassettes, and the inserter, respectively, for selection as an intermediate sheet feeder. Further, the size of a feedable sheet is attached to each of the soft keys. On the present screen, a soft key associated with the manual sheet feeder, one of the sheet feed cassettes, or the inserter is pressed, and then a "next" soft key is pressed to confirm the selection. Thus, the sheet feeder associated with the pressed soft key is set to the sheet feeder for feeding the intermediate sheets.

Next, a finish size is set (step S1005). In this step, the screen illustrated in FIG. 36 by way of example is displayed to enable the user to designate a finish size. On the screen, there are displayed soft keys associated with respective finish sizes for selection. The user can select a size (finish size) to be obtained when the book is trimmed, from the predetermined finish sizes displayed on the screen. Alternatively, the user can also press a "detailed configuration" soft key on the screen in FIG. 36, and specify a desired finish size on the screen shown in FIG. 37.

Then, an original reading mode is set (step S1006). In this step, the screen illustrated in FIG. 38 by way of example is displayed. In the case where an original for a glued-on cover is separate from originals for respective intermediate sheets, a "cover sheet mode" soft key is selected. On the other hand, in the case where originals for respective cover/back cover sheets and originals for respective intermediate sheets are bundled, a "standard mode" soft key is selected.

Then, it is determined whether or not the "cover sheet mode" has been selected as the original reading mode (step S1007). If the "standard sheet mode" has been selected as the original reading mode, the message screen illustrated in FIG. 39 by way of example is displayed (step S1008). This message screen prompts the user to set originals on the document feeder (DF) 100. Then, a bookbinding mode is set in which the original reading mode is set to the "standard mode" (step S1008A). Hereafter, the mode of bookbinding operation performed by setting the original reading mode to the "standard mode" will be referred to as "the standard mode".

If the "cover sheet mode" has been selected as the original reading mode in the step S1006, the message screen illustrated in FIG. 40 by way of example is displayed. This message screen prompts the user to set an original for a cover sheet on the document feeder (DF) 100 and press the start key 602 (step S1009). In response to this, the user presses the start key 602 of the operating and display unit 600.

When the start key 602 is pressed, reading of the cover original is started (step S1010). When the reading of the cover original is completed, the message screen illustrated in FIG. 41 by way of example is displayed (step S1011). This message screen prompts the user to set originals for respective intermediate sheets on the document feeder (DF) 100. Then, a bookbinding mode is set in which the original reading mode is set to the "cover sheet mode" (step S1011A). Hereafter, the mode of bookbinding operation performed by setting the original reading mode to the "cover sheet mode" will be referred to as "the cover sheet mode".

If it is determined in the step S1003 that the inserter has been set to a sheet feeder, a sheet feeder is set for feeding intermediate sheets (step S1012). In this step, the screen illustrated in FIG. 35 by way of example is displayed to enable the user to designate a sheet feeder for feeding intermediate sheets to be wrapped in a glued-on cover. On the present screen, a soft key associated with the manual sheet feeder, one of the sheet feed cassettes, or the inserter is pressed, and then a "next" soft key is pressed to confirm the selection. Thus, the sheet feeder associated with the pressed soft key is set to the sheet feeder for feeding the intermediate sheets.

Next, a finish size is set (step S1013). In this step, the screen illustrated in FIG. 36 by way of example is displayed to enable the user to designate a finish size. On the screen, the user can select a size (finish size) to be obtained when the book is trimmed, from the predetermined finish sizes. Alternatively, the user can also press the "detailed configuration" soft key on the screen in FIG. 36, and specify a desired finish size on the screen shown in FIG. 37.

Then, the message screen illustrated in FIG. 39 by way of example is displayed (step S1014). This message screen prompts the user to set originals on the document feeder (DF) 100. Then, a bookbinding mode in which a cover sheet is fed from the inserter is set (step S1014A). Hereafter, the bookbinding mode in which a cover sheet is fed from the inserter will be referred to as "the inserter mode".

Figure 43:
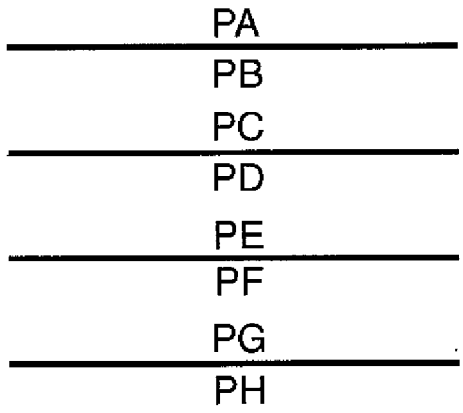
FIG. 43 is a view schematically showing the orientation and order of originals to be set on the document feeder in a standard mode.
Figure 44A:
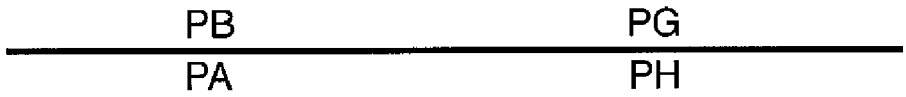
FIG. 44A is a view schematically showing the orientation and order of originals for cover sheets in the case where the user is prompted to set the originals on the document feeder in a cover sheet mode.
Figure 44B:
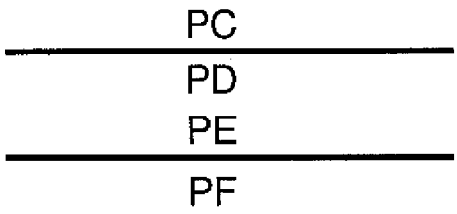
FIG. 44B is a view schematically showing the orientation and order of originals for intermediate sheets in the case where the user is prompted to set the originals on the document feeder in the cover sheet mode.

Next, manners of setting originals, i.e. variations of the orientation and order of originals for selection when setting the originals on the document feeder 100 or the inserter 300 will be described with reference to FIGS. 43 to 45. FIG. 43 is a view schematically showing an orientation and order of originals in the standard mode. FIGS. 44A and 44B are views schematically showing orientations and orders of originals in the cover sheet mode. FIGS. 45A to 45C are views schematically showing orientations and orders of originals in the inserter mode.

Assuming that the number of originals is four, the front face of a first one (i.e. a front cover) is represented by PA, the rear face of the same by PB, the front face of a second one by PC, the rear face of the same by PD, the front face of a third one by PE, the rear face of the same by PF, the front face of a fourth one by PG, and the rear face of the same (i.e. a back cover) by PH. In the standard mode, the originals are set on the document feeder 100 with the leading page PA as an uppermost face, as shown in FIG. 43.

In the cover sheet mode, when the user is prompted to set an original for a glued-on cover, the original is set on the document feeder 100 with the page PA corresponding to the front cover of a product face-down, as shown in FIG. 44A. Further, when the user is prompted to set originals for respective intermediate sheets, the originals are set on the document feeder 100 with the leading page PC as an uppermost face, as shown in FIG. 44B.

In the inserter mode, the originals are set on the feed tray 310 of the inserter 300 with the page PA corresponding to the front cover of a product facing up. In this case, if the binding position of the product set on the screen shown in FIG. 33 is "right side", the originals are set such that the page PA is positioned rightward, as viewed from the rear of the figure, of the page PH corresponding to the back cover of the product as shown in FIG. 45A, whereas if the set binding position of the product is "left side", the originals are set such that the page PA is positioned leftward of the page PH as shown in FIG. 45B. Further, when the user is prompted to set originals for respective intermediate sheets, the originals are set with the leading page PC as an uppermost face, as shown in FIG. 45C.

Figure 46A:
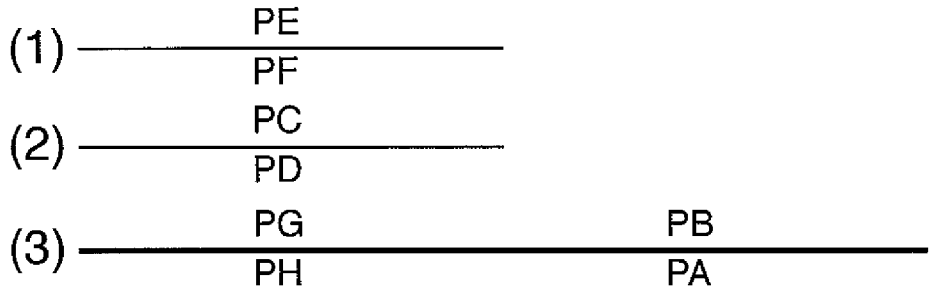
FIG. 46A is a view schematically showing an order in which sheets are discharged from an image forming apparatus main unit in the case where the binding position of a product is set to "right side" in the standard mode or in the cover sheet mode.
Figure 46B:
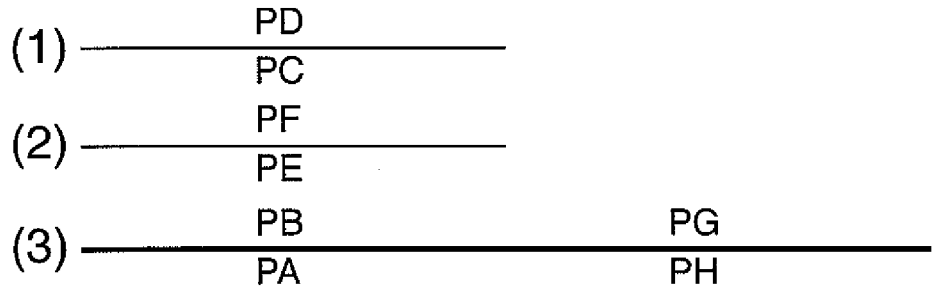
FIG. 46B is a view schematically showing an order in which sheets are discharged from the image forming apparatus main unit in the case where the binding position of a product is set to "left side" in the standard mode or in the cover sheet mode.
Figure 46C:
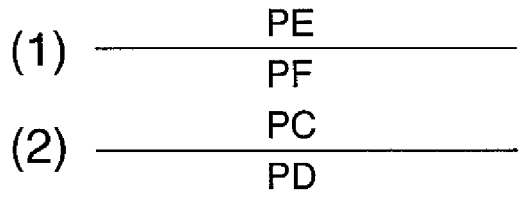
FIG. 46C is a view schematically showing an order in which sheets are discharged from the image forming apparatus main unit in the case where the binding position of a product is set to "right side" in the inserter mode.
Figure 46D:
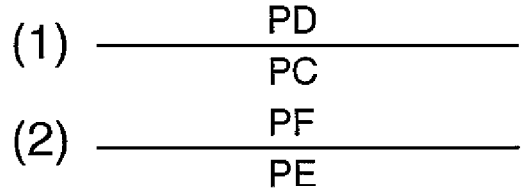
FIG. 46D is a view schematically showing an order in which sheets are discharged from the image forming apparatus main unit in the case where the binding position of a product is set to "left side" in the inserter mode.
Figure 47A:
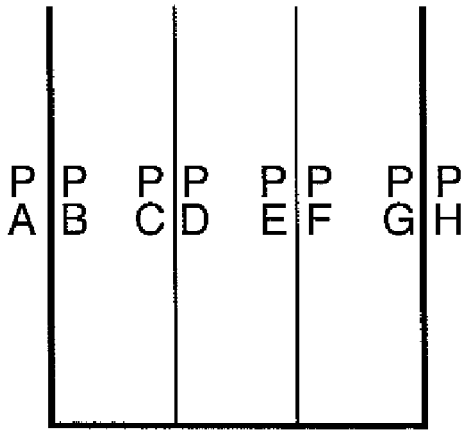
FIG. 47A is a view schematically showing a rightward-openable book corresponding to the sheet discharging order shown in FIG. 46A.
Figure 47B:
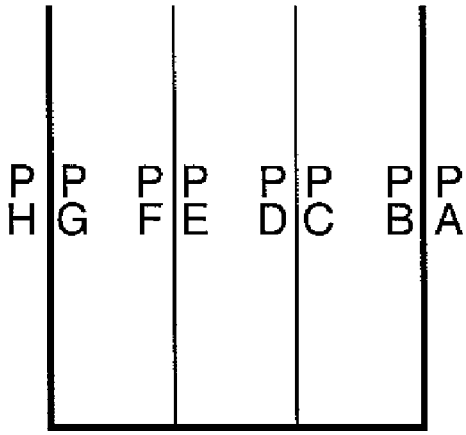
FIG. 47B is a view schematically showing a leftward-openable book corresponding to the sheet discharging order shown in FIG. 46B.

Next, the position (layout) of an image-formed surface of a sheet discharged from the image forming apparatus main unit 10 into the glue binding unit 500 will be described with reference to FIGS. 46A to 46D and FIGS. 47A and 47B. FIG. 46A is a view schematically showing an order in which the sheets are discharged from the image forming apparatus main unit 10 in the case where the binding position of a product is set to "right side" in the standard mode or in the cover sheet mode, whereas FIG. 46B is a view of the order in the case where the binding position of a product is set to "left side" in the same mode. FIG. 46C is a view schematically showing an order in which the sheets are discharged from the image forming apparatus main unit 10 in the case where the binding position of a product is set to "right side" in the inserter mode, whereas FIG. 46D is a view of the order in the case where the binding position of a product is set to "left side" in the same mode. FIG. 47A is a view schematically showing a rightward-openable book corresponding to the sheet discharging order shown in FIG. 46A, whereas FIG. 47B is a view schematically showing a leftward-openable book corresponding to the sheet discharging order shown in FIG. 46B.

When the originals are set in the standard mode shown in FIG. 43 or in the cover sheet mode shown in FIGS. 44A and 44B, and when the binding position of a product is set to "right side", the sheets are discharged from the image forming apparatus main unit 10 into the glue binding unit 500 in the order of (1) to (3) shown in FIG. 46A. Then, the sheets are bound by the glue binding unit 500 into a rightward-openable book as shown in FIG. 47A. On the other hand, when the binding position of a product is set to "left side", the sheets are discharged from the image forming apparatus main unit 10 into the glue binding unit 500 in the order of (1) to (3) shown in FIG. 46B. Then, the sheets are bound into a leftward-openable book as shown in FIG. 47B. In each of FIGS. 47A and 47B, the book is positioned such that its spine cover faces downward, as viewed in FIGS. 47A and 47B, and its top side faces the viewer.

In the cover sheet mode, the page PF is one page of an intermediate sheet corresponding to the last original that was read, as shown in FIG. 44B, and at the same time it is one page of the first sheet that was discharged from the image forming apparatus main unit 10, as shown in FIG. 46A. For this reason, when the binding position of a product is set to "right side" in the cover sheet mode, it is required to start image forming operation after having read the set originals to the end.

Figure 45A:
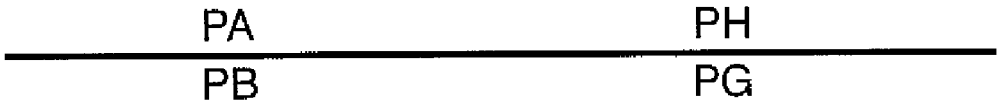
FIG. 45A is a view schematically showing the orientation and order of originals for covers of a book to be bound in a rightward-openable manner, in the case where the originals are set on a feed tray of an inserter in an inserter mode.
Figure 45B:
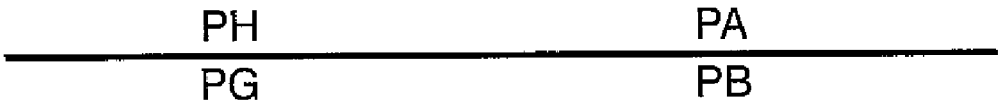
FIG. 45B is a view schematically showing the orientation and order of originals for covers of a book to be bound in a leftward-openable manner, in the case where the originals are set on the feed tray of the inserter in the inserter mode.
Figure 45C:
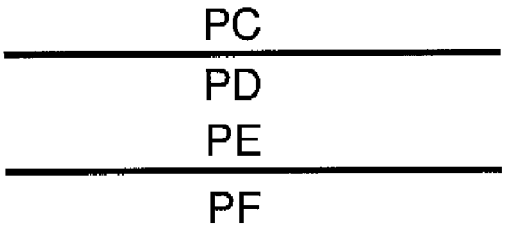
FIG. 45C is a view schematically showing the orientation and order of originals for intermediate sheets of a book in the case where the originals are set on the feed tray of the inserter in the inserter mode.

In the inserter mode shown in FIG. 45A, when the binding position of a product is set to "right side", the sheets are discharged from the image forming apparatus main unit 10 in the order of (1) to (2) shown in FIG. 46C. On the other hand, when the binding position of a product is set to "left side", the sheets are discharged from the image forming apparatus main unit 10 in the order of (1) to (2) shown in FIG. 46D.

Figure 48:
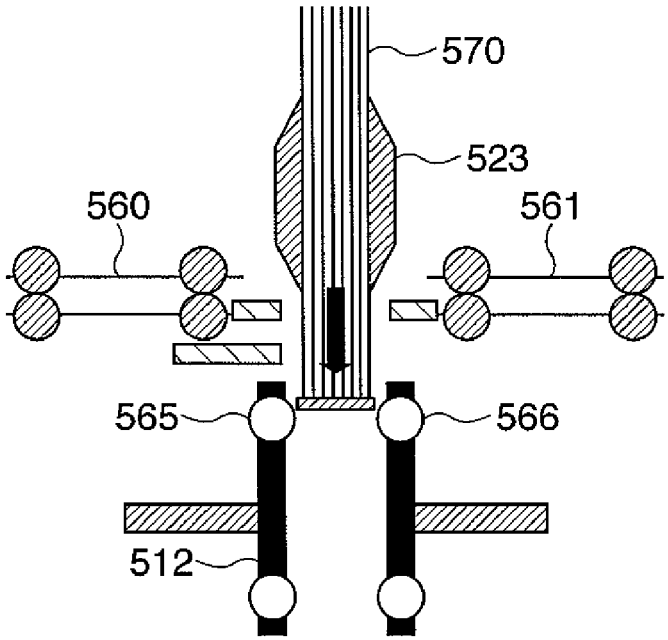
FIG. 48 is a view schematically showing an operation of the gluing section performed during top gluing.
Figure 49:
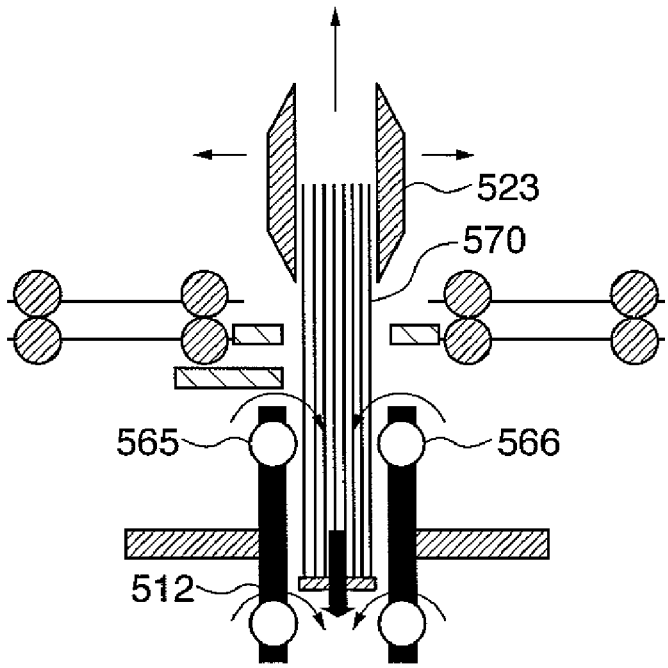
FIG. 49 is a view schematically showing an operation of the gluing section following the operation in FIG. 48.
Figure 50:
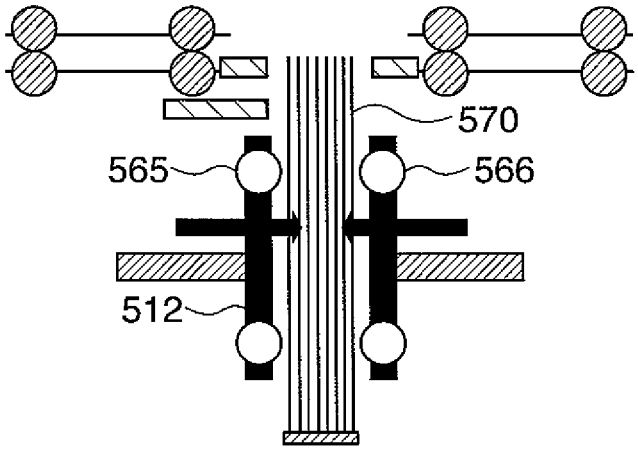
FIG. 50 is a view schematically showing an operation of the bonding section following the operation of the gluing section in FIG. 49.
Figure 51:
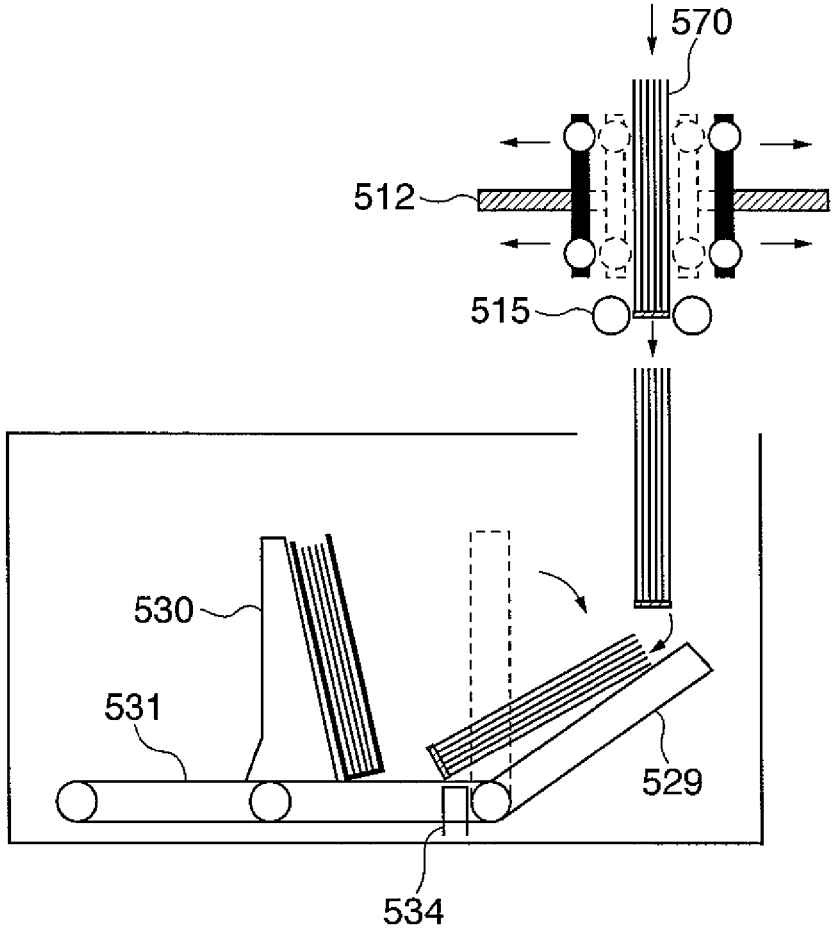
FIG. 51 is a view schematically showing an operation of the book discharging section performed during glue bookbinding.
Figure 52:
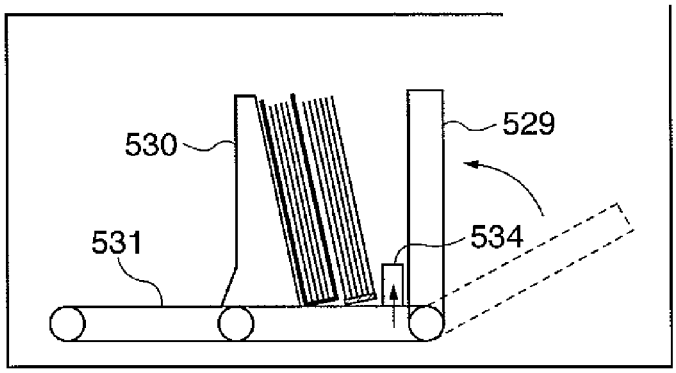
FIG. 52 is a view schematically showing an operation of the book discharging section following the operation in FIG. 51.
Figure 53:
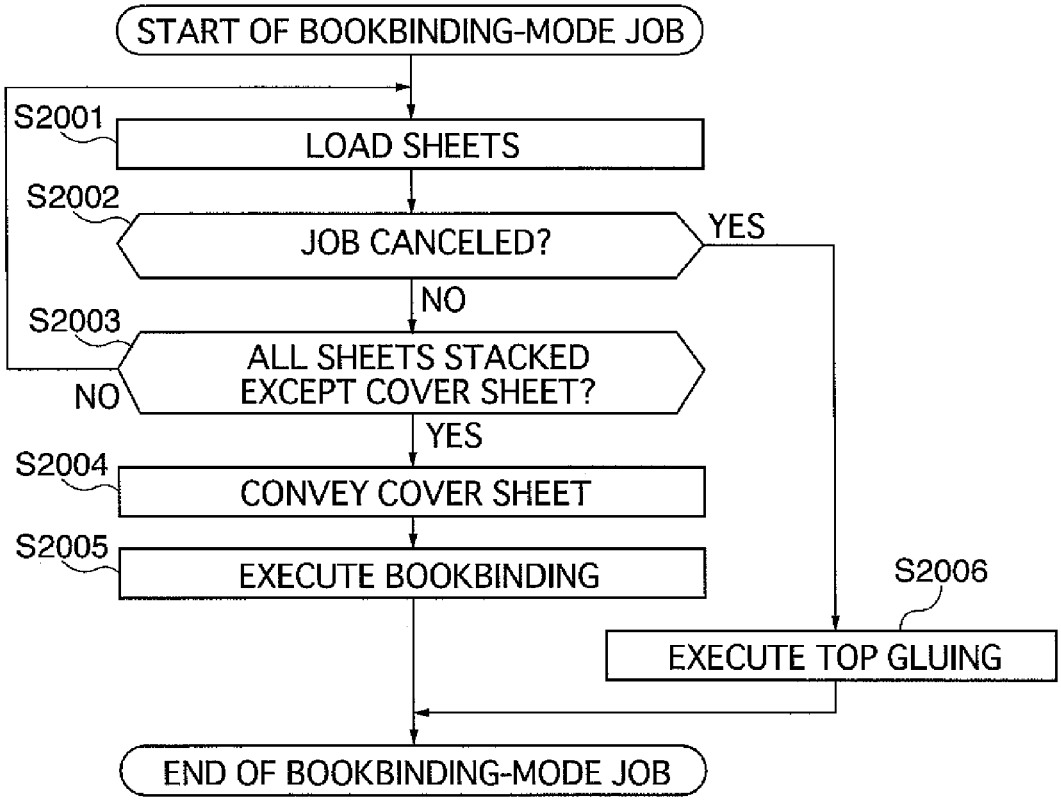
FIG. 53 is a flowchart of a bookbinding-mode process.

Next, a description will be given of a method of discharging a sheet bundle from the sheet stacking tray 520 when a bookbinding-mode job is canceled in the middle of execution thereof, which is one of characterizing features of the present invention, with reference to FIGS. 48 to 53. FIGS. 48 and 49 are views schematically showing an operation of the gluing section B during top gluing. FIG. 50 is a view schematically showing an operation of the bonding section C performed during top gluing. FIGS. 51 and 52 are views schematically showing an operation of the book discharging section E performed during glue bookbinding. FIG. 53 is a flowchart of the bookbinding-mode job. The process represented by the flowchart in FIG. 53 is executed by the sheet processing unit control section 501 under the control of the CPU circuit section 150.

Referring to FIG. 53, when the bookbinding-mode job is started, sheets discharged from the image forming apparatus main unit 10 are sequentially taken into the glue binding unit 500 and are stacked on the sheet stacking section A (step S2001). Then, it is determined whether or not the job has been canceled e.g. by depression of the stop key 603 of the operating and display unit 600 (step S2002). If the job has not been canceled, it is determined whether or not all the sheets except a cover sheet have been stacked on the sheet stacking section A (step S2003). If all the sheets except the cover sheet have been stacked on the sheet stacking section A, the cover sheet discharged from the image forming apparatus main unit 10 is taken into the glue binding unit 500 (step S2004). Then, the bookbinding processing described hereinabove is executed (step S2005).

If it is determined in the step S2002 that the job has been canceled, top gluing is carried out (step S2006). In this top gluing, sheets having undergone an image forming operation before cancellation of the job are stacked on the sheet stacking section A. The sheet bundle stacked on the sheet stacking section A is treated as an unfinished article. This sheet bundle is subjected to gluing in the gluing section B, and then conveyed to the bonding section C. The sheet bundle conveyed to the bonding section C is discharged without being bonded to the cover sheet.

In the gluing section B, the gluing unit 580 is moved, as described hereinabove, longitudinally along the lower end face of the sheet bundle 540 gripped in an upright position by the gluing gripper 523. This causes glue to be applied to the lower end face of the sheet bundle 540 via the glue-applying roller 524.

In the top gluing, wrapping processing is not carried out, and hence the sheet bundle remains gripped by the gluing gripper 523 until the glue applied to the lower end face of the sheet bundle is dried. When a predetermined time period elapses, the gluing gripper 523 is lowered. As a consequence, as shown in FIG. 48, the book 570 is lowered, passing by the conveying guides 560 and 561, to a position where the lower end of the book 570 comes into contact with the pass-to-trim unit rollers 565 and 566.

Thereafter, as shown in FIG. 49, the gluing gripper 523 releases the book 570, whereupon the book 570 is conveyed downward by the pass-to-trim unit rollers 565 and 566.

The book 570 is conveyed to a predetermined position by the pass-to-trim unit rollers 565 and 566, and stopped there. Then, the book 570 is gripped by the trim gripper 512 as indicated by arrows in FIG. 50, and conveyed by the trim gripper 512 toward the inlet roller pair 515 of the book discharging section E immediately below the cutting section D.

Then, the book 570 is conveyed by the inlet roller pair 515 of the book discharging section E as shown in FIG. 51. The trim gripper 512 returns to a predetermined position in the bonding section C after having released the book 570. As shown in FIG. 51, the book 570 is loaded on the loading plate 529 by the inlet roller pair 515. Thereafter, the loading plate 529 pivotally moves to an upright position as shown in FIG. 52, and the book 570 placed on the loading plate 529 is supported in a manner standing against the book support plate 530. At this time, the book discharge stabilizing plate 534 is moved upward, whereby the book 570 is stably supported by the book support plate 530 and the book discharge stabilizing plate 534. Thereafter, the book support plate 530 is moved leftward by the discharge conveyor belt 531 so as to secure a discharge space for the next book to be conveyed.

As described above, according to the present embodiment, when the bookbinding-mode job is canceled in the middle of execution thereof, the sheet bundle left in the glue binding unit 500 is glued, and then conveyed to the book discharging section E, so that the user can easily remove the sheet bundle. Further, since the sheet bundle is glued, it is possible to prevent the sheets forming the sheet bundle from being separated, which saves the user additional labor in removing the sheet bundle.

Figure 54:
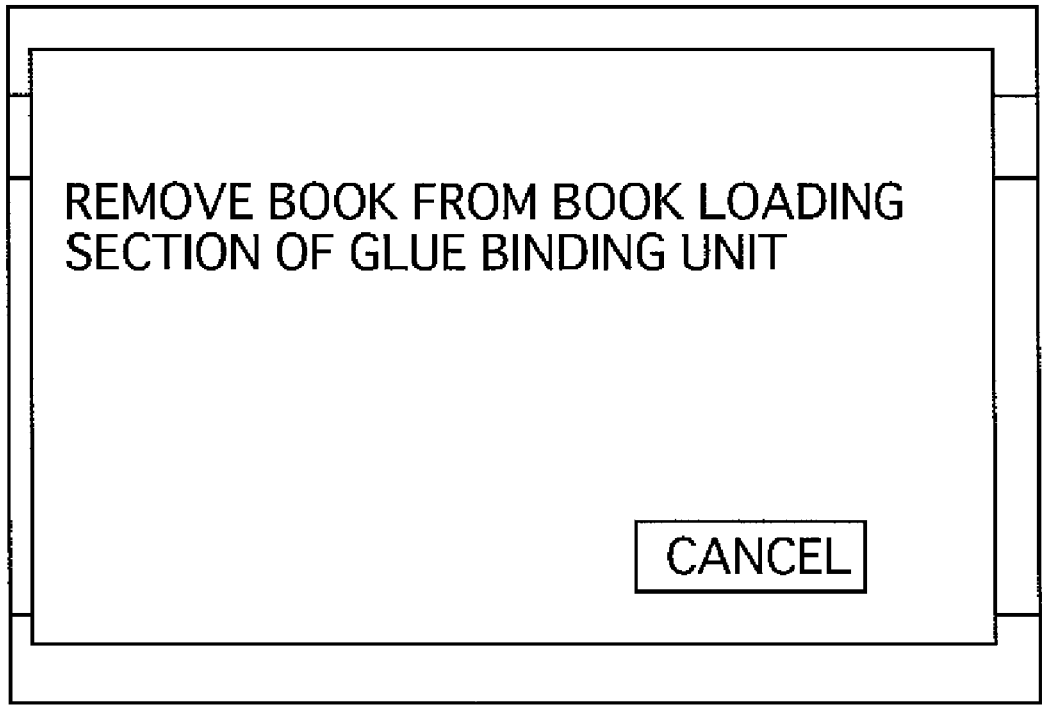
FIG. 54 is a view illustrating an example of a message screen notifying the user of an excessively stacked condition of a top-glued book in an image forming apparatus according to a second embodiment of the present invention.

Next, a second embodiment will be described with reference to FIG. 54. FIG. 54 is a view illustrating an example of a message screen notifying the user of an excessively stacked condition of a top-glued book in an image forming apparatus according to the second embodiment of the present invention.

The top-glued book is neither wrapped in a cover sheet nor pressure-bonded, and therefore the side faces of the glued sheet bundle are not flat. As a result, when a top-glued book is placed in the book discharging section E, the placement state of the book discharging section E inevitably becomes unstable. To avoid this, when a top-glued book is placed in the book discharging section E, the book discharging section E is regarded to be in an excessively stacked state, and input of a new job is inhibited. Further, as shown in FIG. 54, a message prompting the user to remove the book is displayed on the liquid crystal display 620. Then, when the user removes the book from the book discharging section E, inhibition of job input is canceled to enable input of a new job. It should be noted that the display section for displaying the message may be provided in the glue binding unit.

It is to be understood that the object of the present invention may also be accomplished by supplying a system or an apparatus with a storage medium in which a program code of software, which realizes the functions of either of the above described embodiments is stored, and causing a computer (or CPU or MPU) of the system or apparatus to read out and execute the program code stored in the storage medium.

In this case, the program code itself read from the storage medium realizes the functions of either of the above described embodiments, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of either of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

Although in the above embodiments, the electrophotographic printing is adopted as the printing method executed by the complex apparatus, there is no intention to limit the invention to this. For example, the present invention may be applied to a variety of printing methods such as ink-jet printing, thermal transfer, thermal printing, electrostatic printing, and discharge breakdown printing.

The form of the program may be an object code, a program code executed by an interpreter, or script data supplied to an OS (Operating System).

This application claims priority from Japanese Patent Application No. 2005-250116 filed Aug. 30, 2005, which is hereby incorporated by reference herein.

What is claimed is:

1. An image forming apparatus provided with a bookbinding mode for forming images on a plurality of sheets and binding the sheets having the images formed thereon into a book, comprising:

a sheet stacking device that stacks a plurality of sheets as one set of sheet bundle;

a gluing device that applies glue to an end face of the sheet bundle stacked on said sheet stacking device;

a discharge device that discharges the glue-applied sheet bundle from the apparatus; and a control device that, after said sheet stacking device stacks all of the sheets to be bound as the one set of sheet bundle for a bookbinding-mode job, controls said gluing device to apply glue to the end face of the sheet bundle, and thereafter controls said discharge device to discharge the glue-applied sheet bundle, wherein in the case where the bookbinding-mode job is canceled before said sheet stacking device stacks all of the sheets to be bound as the one set of sheet bundle, said control device causes said gluing device to apply glue to the end face of a sheet bundle having been stacked by said sheet stacking device, and thereafter causes said discharge device to discharge the glue-applied sheet bundle.

2. An image forming apparatus as claimed in claim 1, further comprising a cutting device that trims off a predetermined portion from the glue-applied sheet bundle, and wherein said control device controls said cutting device and said discharge device so as to cause said cutting device to trim the glue-applied sheet bundle, and thereafter to cause said discharge device to discharge the trimmed sheet bundle, and wherein in the case where the bookbinding mode job is canceled before said sheet stacking device stacks all of the sheets to be bound as the one set of sheet bundle, said control device causes said discharge device to discharge the glue-applied sheet bundle without causing said cutting device to trim the glue-applied sheet bundle.

3. An image forming apparatus as claimed in claim 1, further comprising a book loading device that has the glue-applied sheet bundle loaded thereon in a manner removable from outside, and wherein in the case where the bookbinding-mode job is canceled before said sheet stacking device stacks all of the sheets to be bound as the one set of sheet bundle, said control device causes the glue-applied sheet bundle to be loaded on said book loading device.

4. An image forming apparatus as claimed in claim 3, further comprising a display device that displays messages for a user, and wherein in the case where the bookbinding-mode job is canceled before said sheet stacking device stacks all of the sheets to be bound as the one set of sheet bundle, said control device causes said display device to display a message prompting the user to remove the glue-applied sheet bundle loaded on said book loading device.

5. A sheet processing apparatus that is connected to an image forming apparatus for forming images on sheets, and binds a plurality of sheets having images formed thereon by the image forming apparatus into a book, comprising:

a sheet stacking device that stacks a plurality of sheets as one set of sheet bundle;

a gluing device that applies glue to an end face of the sheet bundle stacked on said sheet stacking device;

a discharge device that discharges the glue-applied sheet bundle from the sheet processing apparatus; and a control device that, after said sheet stacking device stacks all of the sheets to be bound as the one set of sheet bundle for a bookbinding-mode job, controls said gluing device to apply glue to the end face of the sheet bundle, and thereafter controls said discharge device to discharge the glue-applied sheet bundle, wherein in the case where the bookbinding-mode job is canceled before said sheet stacking device stacks all of the sheets to be bound as the one set of sheet bundle, said control device causes said gluing device to apply glue to the end face of a sheet bundle having been stacked by said sheet stacking device, and thereafter causes said discharge device to discharge the glue-applied sheet bundle.

6. A sheet processing apparatus as claimed in claim 5, further comprising a cutting device that trims off a predetermined portion from the glue-applied sheet bundle, and wherein said control device controls said cutting device and said discharge device so as to cause said cutting device to trim the glue-applied sheet bundle, and thereafter to cause said discharge device to discharge the trimmed sheet bundle, and wherein in the case where the bookbinding mode job is canceled before said sheet stacking device stacks all of the sheets to be bound as the one set of sheet bundle, said control device causes said discharge device to discharge the glue-applied sheet bundle without causing said cutting device to trim the glue-applied sheet bundle.

7. A sheet processing apparatus as claimed in claim 5, further comprising a book loading device that has the glue-applied sheet bundle loaded thereon in a manner removable from outside, and wherein in the case where the bookbinding-mode job is canceled before said sheet stacking device stacks all of the sheets to be bound as the one set of sheet bundle, said control device causes the glue-applied sheet bundle to be loaded on said book loading device.

8. A method of controlling an image forming apparatus provided with a bookbinding mode for forming images on a plurality of sheets and binding the sheets having the images formed thereon into a book, having a sheet stacking device that stacks a plurality of sheets as one set of sheet bundle, a gluing device that applies glue to an end face of the sheet bundle stacked on the sheet stacking device, and a discharge device that discharges the glue-applied sheet bundle from the sheet processing apparatus, comprising:

a first control step of, after the sheet stacking device stacks all of the sheets to be bound as the one set of sheet bundle for a bookbinding-mode job, controlling the gluing device to apply glue to the end face of the sheet bundle, and thereafter controlling the discharge device to discharge the glue-applied sheet bundle; and a second control step of causing the gluing device, in the case where the bookbinding-mode job is canceled before the sheet stacking device stacks all of the sheets to be bound as the one set of sheet bundle, to apply glue to the end face of a sheet bundle having been stacked by the sheet stacking device, and thereafter causing the discharge device to discharge the glue-applied sheet bundle.

9. A method of controlling a sheet processing apparatus that is connected to an image forming apparatus for forming images on sheets, and binds a plurality of sheets having images formed thereon by the image forming apparatus into a book, having a sheet stacking device that stacks a plurality of sheets as one set of sheet bundle, a gluing device that applies glue to an end face of the sheet bundle stacked on the sheet stacking device, and a discharge device that discharges the glue-applied sheet bundle from the sheet processing apparatus, comprising:

a first control step of, after the sheet stacking device stacks all of the sheets to be bound as the one set of sheet bundle for a bookbinding-mode job, controlling the gluing device to apply glue to the end face of the sheet bundle, and thereafter controlling the discharge device to discharge the glue-applied sheet bundle; and a second control step of causing the gluing device, in the case where the bookbinding-mode job is canceled before the sheet stacking device stacks all of the sheets to be bound as the one set of sheet bundle, to apply glue to the end face of a sheet bundle having been stacked by the sheet stacking device, and thereafter causing the discharge device to discharge the glue-applied sheet bundle.

10. An image forming apparatus provided with a bookbinding mode for forming images on a plurality of sheets and binding the sheets having the images formed thereon into a book, comprising:

a sheet stacking device that stacks a plurality of sheets as one set of sheet bundle;

a gluing device that applies glue to an end face of the sheet bundle stacked on said sheet stacking device;

a discharge device that discharges the glue-applied sheet bundle from the apparatus; and a control device that, after said sheet stacking device stacks all of the sheets to be bound as the one set of sheet bundle for a bookbinding-mode job, controls said gluing device to apply glue to the end face of the sheet bundle, and thereafter to cause said discharge device to discharge the glue-applied sheet bundle, wherein in the case where the bookbinding-mode job is canceled before the gluing operation is performed by the gluing device, said control device causes said gluing device to apply glue to the end face of a sheet bundle having been stacked by said sheet stacking device without causing said sheet stacking device to stack all of the sheets to be bound, and thereafter causes said discharge device to discharge the glue-applied sheet bundle.

11. A sheet processing apparatus that is connected to an image forming apparatus for forming images on sheets, and binds a plurality of sheets having images formed thereon by the image forming apparatus into a book, comprising:

a sheet stacking device that stacks a plurality of sheets as one set of sheet bundle;

a gluing device that applies glue to an end face of the sheet bundle stacked on said sheet stacking device;

a discharge device that discharges the glue-applied sheet bundle from the sheet processing apparatus; and a control device that, after said sheet stacking device stacks all of the sheets to be bound as the one set of sheet bundle for a bookbinding-mode job, controls said gluing device to apply glue to the end face of the sheet bundle, and thereafter to cause said discharge device to discharge the glue-applied sheet bundle, wherein in the case where the bookbinding-mode job is canceled before the gluing operation is performed by the gluing device, said control device causes said gluing device to apply glue to the end face of a sheet bundle having been stacked by said sheet stacking device without causing said sheet stacking device to stack all of the sheets to be bound, and thereafter causes said discharge device to discharge the glue-applied sheet bundle.

12. A method of controlling an image forming apparatus provided with a bookbinding mode for forming images on a plurality of sheets and binding the sheets having the images formed thereon into a book, having a sheet stacking device that stacks a plurality of sheets as one set of sheet bundle, a gluing device that applies glue to an end face of the sheet bundle stacked on the sheet stacking device, and a discharge device that discharges the glue-applied sheet bundle from the sheet processing apparatus, comprising:

a first control step of, after the sheet stacking device stacks all of the sheets to be bound as the one set of sheet bundle for a bookbinding-mode job, controlling the gluing device to apply glue to the end face of the sheet bundle, and thereafter causing the discharge device to discharge the glue-applied sheet bundle; and a second control step of causing the gluing device, in the case where the bookbinding-mode job is canceled before the gluing operation is performed by the gluing device, to apply glue to the end face of a sheet bundle having been stacked by the sheet stacking device without causing the sheet stacking device to stack all of the sheets to be bound, and thereafter causing the discharge device to discharge the glue-applied sheet bundle.

13. A method of controlling a sheet processing apparatus that is connected to an image forming apparatus for forming images on sheets, and binds a plurality of sheets having images formed thereon by the image forming apparatus into a book, having a sheet stacking device that stacks a plurality of sheets as one set of sheet bundle, a gluing device that applies glue to an end face of the sheet bundle stacked on the sheet stacking device, and a discharge device that discharges the glue-applied sheet bundle from the sheet processing apparatus, comprising:

a first control step of, after the sheet stacking device stacks all of the sheets to be bound as the one set of sheet bundle for a bookbinding-mode job, controlling the gluing device to apply glue to the end face of the sheet bundle, and thereafter to causing the discharge device to discharge the glue-applied sheet bundle; and a second control step of causing the gluing device, in the case where the bookbinding-mode job is canceled before the gluing operation is performed by the gluing device, to apply glue to the end face of a sheet bundle having been stacked by the sheet stacking device without causing the sheet stacking device to stack all of the sheets to be bound, and thereafter causing the discharge device to discharge the glue-applied sheet bundle.

* * * * *